US006714138B1

(12) United States Patent
Turner et al.

(10) Patent No.: US 6,714,138 B1
(45) Date of Patent: Mar. 30, 2004

(54) METHOD AND APPARATUS FOR TRANSMITTING INFORMATION TO THE SURFACE FROM A DRILL STRING DOWN HOLE IN A WELL

(75) Inventors: William Evans Turner, Durham, CT (US); Denis P. Biglin, Jr., Glastonbury, CT (US)

(73) Assignee: APS Technology, Inc., Cromwell, TN (US)

( * ) Notice: Subject to any disclaimer, the term of this patent is extended or adjusted under 35 U.S.C. 154(b) by 238 days.

(21) Appl. No.: 09/676,379

(22) Filed: Sep. 29, 2000

(51) Int. Cl.[7] ..... G01V 3/00

(52) U.S. Cl. ..... 340/854.3; 340/855.4; 340/856.4; 367/84

(58) Field of Search ..... 340/854.3, 855.4, 340/856.4; 367/83, 84

(56) References Cited

U.S. PATENT DOCUMENTS

| | | | | |
|---|---|---|---|---|
| 2,901,685 | A | 8/1959 | Alder | 323/74 |
| 2,964,116 | A | 12/1960 | Peterson | 175/48 |
| 2,973,505 | A | 2/1961 | Johannesen | 340/18 |
| 3,065,416 | A | 11/1962 | Jeter | 324/70 |
| 3,302,457 | A | 2/1967 | Mayes | 73/152 |
| 3,309,656 | A | 3/1967 | Godbey | 340/18 |
| 3,693,428 | A | 9/1972 | LePeuvedic et al. | 73/151 |
| 3,713,089 | A | 1/1973 | Clacomb | 340/18 LD |
| 3,732,728 | A | 5/1973 | Fitzpatrick | 73/151 |
| 3,736,558 | A | 5/1973 | Cubberly, Jr. | 340/18 |
| 3,737,843 | A | 6/1973 | LePeuvedic et al. | 340/18 NC |
| 3,739,331 | A | 6/1973 | Godbey et al. | 340/18 LD |
| 3,742,443 | A | 6/1973 | Foster et al. | 340/18 LD |
| 3,764,968 | A | 10/1973 | Anderson | 340/18 NC |
| 3,764,969 | A | 10/1973 | Cubberly, Jr. | 340/18 NC |
| 3,764,970 | A | 10/1973 | Manning | 340/18 NC |
| 3,770,006 | A | 11/1973 | Sexton et al. | 137/499 |
| 3,958,217 | A | 5/1976 | Spinnler | 340/18 LD |
| 3,964,556 | A | 6/1976 | Gearhart et al. | 175/45 |
| 4,007,805 | A | 2/1977 | Reber | 181/120 |
| RE29,734 | E | 8/1978 | Manning | 340/18 NC |
| RE30,055 | E | 7/1979 | Claycomb | 340/18 LD |
| 4,351,037 | A | 9/1982 | Scherbatskoy | 367/85 |

(List continued on next page.)

FOREIGN PATENT DOCUMENTS

| | | |
|---|---|---|
| GB | 2156405 A | 10/1985 |

*Primary Examiner*—Timothy Edwards
(74) *Attorney, Agent, or Firm*—Woodcock Washburn LLP

(57) ABSTRACT

A method and apparatus for transmitting information to the surface from down hole in a well in which a pulser is incorporated into the bottom hole assembly of a drill string that generates pressure pulses encoded to contain information concerning the drilling operation. The pressure pulses travel to the surface where they are decoded so as to decipher the information. The pulser includes a stator forming passages through which drilling fluid flows on its way to the drill bit. The rotor has blades that obstruct the flow of drilling fluid through the passages when the rotor is rotated into a first orientation and that relieve the obstruction when rotated into a second orientation, so that oscillation of the rotor generates the encoded pressure pulses. An electric motor, under the operation of a controller, drives a drive train that oscillates the rotor between the first and second orientations. The electric motor is located in an air-filled chamber whereas the major portion of the drive train is located in a liquid-filled chamber. The controller controls one or more characteristics of the pressure pulses by varying the oscillation of the rotor. The controller may receive information concerning the characteristics of the pressure pulses from a pressure sensor mounted proximate the bottom hole assembly, as well as information concerning the angular orientation of the rotor by means of an encoder. The controller may also receive instructions for controlling the pressure pulse characteristic from the surface by means of encoded pressure pulses transmitted to the pulser from the surface that are sensed by the pressure sensor and decoded by the controller.

54 Claims, 14 Drawing Sheets

U.S. PATENT DOCUMENTS

| | | | | |
|---|---|---|---|---|
| 4,462,469 | A | 7/1984 | Brown | 175/40 |
| 4,499,563 | A | 2/1985 | Jürgens | 367/84 |
| 4,628,495 | A | 12/1986 | Peppers et al. | 367/85 |
| 4,630,244 | A | 12/1986 | Larronde | 367/84 |
| RE32,463 | E | 7/1987 | Westlake et al. | 175/48 |
| 4,698,794 | A | 10/1987 | Kruger et al. | 367/83 |
| 4,734,892 | A | 3/1988 | Kotlyar | 367/83 |
| 4,785,300 | A | 11/1988 | Chin et al. | 340/861 |
| 4,790,393 | A | 12/1988 | Larronde et al. | 175/40 |
| 4,796,699 | A | 1/1989 | Upchurch | 166/250 |
| 4,847,815 | A | 7/1989 | Malone | 367/84 |
| 4,914,637 | A | 4/1990 | Goodsman | 367/83 |
| 4,915,168 | A | 4/1990 | Upchurch | 166/250 |
| 4,956,823 | A | 9/1990 | Russell et al. | 367/84 |
| 5,073,877 | A | 12/1991 | Jeter | 367/84 |
| 5,079,750 | A | 1/1992 | Scherbatskoy | 367/85 |
| 5,113,379 | A | 5/1992 | Scherbatskoy | 367/83 |
| 5,119,344 | A | 6/1992 | Innes | 367/84 |
| 5,182,731 | A | 1/1993 | Hoelscher et al. | 367/84 |
| 5,189,645 | A | 2/1993 | Innes | 367/84 |
| 5,215,152 | A | 6/1993 | Duckworth | 175/48 |
| 5,357,483 | A | 10/1994 | Innes | 367/84 |
| 5,517,464 | A | 5/1996 | Lerner et al. | 367/84 |
| 5,586,084 | A | 12/1996 | Barron et al. | 367/85 |
| 5,691,712 | A | 11/1997 | Meek et al. | 340/853.3 |
| 5,787,052 | A | 7/1998 | Gardner et al. | 367/84 |
| 6,105,690 | A | 8/2000 | Biglin, Jr. et al. | 175/48 |
| 6,289,998 | B1 | 9/2001 | Krueger et al. | 175/25 |
| 6,469,637 | B1 | 10/2002 | Seyler et al. | 340/856.3 |

METHOD AND APPARATUS FOR TRANSMITTING INFORMATION TO THE SURFACE FROM A DRILL STRING DOWN HOLE IN A WELL

FIELD OF THE INVENTION

The current invention is directed to a method and apparatus for transmitting information from a down hole location in a well to the surface, such as that used in a mud pulse telemetry system employed in a drill string for drilling an oil well.

BACKGROUND OF THE INVENTION

In underground drilling, such as gas, oil or geothermal drilling, a bore is drilled through a formation deep in the earth. Such bores are formed by connecting a drill bit to sections of long pipe, referred to as a "drill pipe," so as to form an assembly commonly referred to as a "drill string" that extends from the surface to the bottom of the bore. The drill bit is rotated so that it advances into the earth, thereby forming the bore. In rotary drilling, the drill bit is rotated by rotating the drill string at the surface. In directional drilling, the drill bit is rotated by a down hole mud motor coupled to the drill bit; the remainder of the drill string is not rotated during drilling. In a steerable drill string, the mud motor is bent at a slight angle to the centerline of the drill bit so as to create a side force that directs the path of the drill bit away from a straight line. In any event, in order to lubricate the drill bit and flush cuttings from its path, piston operated pumps on the surface pump a high pressure fluid, referred to as "drilling mud," through an internal passage in the drill string and out through the drill bit. The drilling mud then flows to the surface through the annular passage formed between the drill string and the surface of the bore.

Depending on the drilling operation, the pressure of the drilling mud flowing through the drill string will typically be between 1,000 and 25,000 psi. In addition, there is a large pressure drop at the drill bit so that the pressure of the drilling mud flowing outside the drill string is considerably less than that flowing inside the drill string. Thus, the components within the drill string are subject to large pressure forces. In addition, the components of the drill string are also subjected to wear and abrasion from drilling mud, as well as the vibration of the drill string.

The distal end of a drill string, which includes the drill bit, is referred to as the "bottom hole assembly." In "measurement while drilling" (MWD) applications, sensing modules in the bottom hole assembly provide information concerning the direction of the drilling. This information can be used, for example, to control the direction in which the drill bit advances in a steerable drill string. Such sensors may include a magnetometer to sense azimuth and accelerometers to sense inclination and tool face.

Historically, information concerning the conditions in the well, such as information about the formation being drill through, was obtained by stopping drilling, removing the drill string, and lowering sensors into the bore using a wire line cable, which were then retrieved after the measurements had been taken. This approach was known as wire line logging. More recently, sensing modules have been incorporated into the bottom hole assembly to provide the drill operator with essentially real time information concerning one or more aspects of the drilling operation as the drilling progresses. In "logging while drilling" (LWD) applications, the drilling aspects about which information is supplied comprise characteristics of the formation being drilled through. For example, resistivity sensors may be used to transmit, and then receive, high frequency wavelength signals (e.g., electromagnetic waves) that travel through the formation surrounding the sensor. By comparing the transmitted and received signals, information can be determined concerning the nature of the formation through which the signal traveled, such as whether it contains water or hydrocarbons. Other sensors are used in conjunction with magnetic resonance imaging (MRI). Still other sensors include gamma scintillators, which are used to determine the natural radioactivity of the formation, and nuclear detectors, which are used to determine the porosity and density of the formation.

In traditional LWD and MWD systems, electrical power was supplied by a turbine driven by the mud flow. More recently, battery modules have been developed that are incorporated into the bottom hole assembly to provide electrical power.

In both LWD and MWD systems, the information collected by the sensors must be transmitted to the surface, where it can be analyzed. Such data transmission is typically accomplished using a technique referred to as "mud pulse telemetry." In a mud pulse telemetry system, signals from the sensor modules are typically received and processed in a microprocessor-based data encoder of the bottom hole assembly, which digitally encodes the sensor data. A controller in the control module then actuates a pulser, also incorporated into the bottom hole assembly, that generates pressure pulses within the flow of drilling mud that contain the encoded information. The pressure pulses are defined by a variety of characteristics, including amplitude (the difference between the maximum and minimum values of the pressure), duration (the time interval during which the pressure is increased), shape, and frequency (the number of pulses per unit time). Various encoding systems have been developed using one or more pressure pulse characteristics to represent binary data (i.e., bit 1 or 0)—for example, a pressure pulse of 0.5 second duration represents binary 1, while a pressure pulse of 1.0 second duration represents binary 0. The pressure pulses travel up the column of drilling mud flowing down to the drill bit, where they are sensed by a strain gage based pressure transducer. The data from the pressure transducers are then decoded and analyzed by the drill rig operating personnel.

Various techniques have been attempted for generating the pressure pulses in the drilling mud. One technique involves the use of axially reciprocating valves, such as that disclosed in U.S. Pat. Nos. 3,958,217 (Spinnler); 3,713,089 (Clacomb); and 3,737,843 (Le Peuvedic et al.), each of which is hereby incorporated by reference in its entirety. Another technique involves the use of rotary pursers. Typically, rotary pulsers utilizes a rotor in conjunction with a stator. The stator has vanes that form passages through which the drilling mud flows. The rotor has blades that, when aligned with stator passages, restrict the flow of drilling mud, thereby resulting in an increase in drilling mud pressure, and, when not so aligned, eliminate the restriction. Rotation of the rotor is driven by the flow of drilling mud or an electric motor powered by a battery. Typically, the motor is a brushless DC motor mounted in an oil-filled chamber pressurized to a pressure close to that of the drilling mud to minimize the pressure gradient acting on the housing enclosing the motor.

In one type of rotary pulser, sometimes referred to as a "turbine" or "siren," the rotor rotates more or less continuously so as to create an acoustic carrier signal within the drilling mud. A siren type rotary pulser is disclosed in U.S. Pat. Nos. 3,770,006 (Sexton et al.) and 4,785,300 (Chin et al.), each of which is hereby incorporated by reference in their entirety. Encoding can be accomplished based on shifting the phase of the acoustic signal relative to a reference signal—for example, a shift in phase may represent one binary bit (e.g., 1), while the absence of a phase shift may indicate another bit (e.g., 0).

In another type of rotary pulser, in which the rotor is typically driven by the mud flow, the rotor increments in discrete intervals. Operation of a latching or escapement mechanism, for example by means of an electrically operated solenoid, may be used to actuate the incremental rotation of the rotor into an orientation in which its blades block the stator passages, thereby resulting in an increase in drilling mud pressure that may be sensed at the surface. The next incremental rotation unblocks the stator passages, thereby resulting in a reduction in drilling mud pressure that may likewise be sensed at the surface. Thus, the incremental rotation of the rotor creates pressure pulses that are transmitted to the surface detector. A rotary pulser of this type is disclosed in U.S. Pat. No. 4,914,637 (Goodsman), incorporated by reference herein in its entirety.

Unfortunately, conventional rotary pulsers suffer from disadvantages that result from the fact that the characteristics of the pressure pulses cannot be adequately controlled in situ to optimize the transmission of information. For example, under any given mud flow situation, each increment of the rotor of an incremental type rotary pulser will result in a constant amplitude pressure pulses being generated at the pulser. As the drilling progresses, the distance between the pulser and the surface detector increases, thereby resulting in increased attenuation of the pressure pulses by the time they reach the surface. This can make it more difficult for the pressure pulses to be detected at the surface. Moreover, from time to time, extraneous pressure pulses from other sources, such as mud pumps, may become more pronounced or may occur at a frequency closer to that of the pressure pulses containing the data to be transmitted, making data acquisition by the surface detection system more difficult. In such situations, data transmission could be improved by increasing the amplitude or varying the frequency or even the shape of the pressure pulses generated by the pulser.

In prior art systems, such situations can only be remedied by removing the pulser, which requires cessation of drilling and withdrawal of the drill string from the well so that physical adjustments can be made to the pulser, for example, mechanically increasing the size of the rotor increment so as to increase the amplitude and duration of the pulses, or adjusting the motor control to alter the pulser speed.

Note that although increasing the magnitude of the rotor increment will increase the duration, and often the amplitude, of the pressure pulses, it will also increase the time necessary to create the pulse, thereby reducing the data transmission rate. Thus, optimal performance will not be obtained by generating pressure pulses of greater than necessary duration or amplitude, and there are some situations in which it may be desirable to decrease the amplitude of the pressure pulses as the drilling progresses. Current systems, however, do not permit such optimization of the data transmission rate.

Conventional pulsers suffer from other disadvantages as well. For example, due to the high pressure of the drilling mud, rotary seals between the rotor shaft and the stationary components are subject to leakage. Moreover, the brushless DC motors used to drive the rotor consume relatively large amounts of power, limiting battery life. While brushed DC motors consume less power, they cannot be used in an oil-filled pulser housing of the type typically used in an MWD/LWD system.

Consequently, it would be desirable to provide a method and apparatus for generating pressure pulses in a mud pulse telemetry system in which one or more characteristics of the pressure pulses generated at the pulser could be adjusted in situ at the down hole location—that is, without withdrawing the drill sting from the well. It would also be desirable to provide a pulser having a durable seal that was resistant to leakage and powered by a low power consuming brushed DC motor.

SUMMARY OF THE INVENTION

It is an object of the current invention to provide an improved method of transmitting information from a portion of a drill string operating at a down hole location in a well bore to a location proximate the surface of the earth. This and other objects are achieved in a method of transmitting information from a portion of a drill string operating at a down hole location in a well bore to a location proximate the surface of the earth comprising the steps of (i) generating pressure pulses in the drilling fluid flowing through the drill string that are encoded to contain the information to be transmitted, and (ii) controlling a characteristic of the pressure pulses, such as amplitude, duration, frequency, or phase, in situ at the down hole location.

In one embodiment, the method comprises the steps of (i) directing drilling fluid along a flow path extending through the down hole portion of the drill string, (ii) directing the drilling fluid over a rotor disposed in the down hole portion of the drill string, the rotor capable of at least partially obstructing the flow of fluid through the flow path by rotating in a first direction and of thereafter reducing the obstruction of the flow path by rotating in an opposite direction, (iii) creating pressure pulses encoded to contain the information in the drilling fluid that propagate toward the surface location, each of the pressure pulses created by oscillating the rotor by rotating the rotor in the first direction through an angle of rotation so as to obstruct the flow path and then reversing the direction of rotation and rotating the rotor in the opposite direction so as to reduce the obstruction of the flow path, and (iv) making an adjustment to at least one characteristic of the pressure pulses by adjusting the oscillation of the rotor, the adjustment of the oscillation of the rotor performed in situ at the down hole location.

In a preferred embodiment, the method includes the step of transmitting instructional information from the surface to the down hole location for controlling the pressure pulse characteristic. In one embodiment, the instructional information is transmitted by generating pressure pulses at the surface and transmitting them to the down hole location where they are sensed by a pressure sensor and deciphered.

The invention also encompasses an apparatus for transmitting information from a portion of a drill string operating at a down hole location in a well bore to a location proximate the surface of the earth, the drill string having a passage through which a drilling fluid flows, comprising (i) a housing for mounting in the drill string passage, first and second chambers formed in the housing, the first and second chambers being separated from each other, the first chamber filled with a gas, the second chamber filled with a liquid, (ii) a rotor capable of at least partially obstructing the flow of the drilling fluid through the passage when rotated into a first angular orientation and of reducing the obstruction when rotated into a second angular orientation, whereby rotation of the rotor creates pressure pulses in the drilling fluid, (iii) a drive train for rotating the rotor, at least a first portion of the drive train located in the liquid filled second chamber, (iv) an electric motor for driving rotation of the drive train, the electric motor located in the gas-filled first chamber.

In a preferred embodiment, the apparatus also includes a stator in which the passage is formed. A seal is fixedly attached at one end to the rotor and at the other end to the stator, so that the seal undergoes torsional deflection as the rotor oscillates. The clearance between the rotor and stator is tapered so as to prevent jamming by debris in the drilling fluid.

BRIEF DESCRIPTION OF THE DRAWINGS

FIG. 1(*a*) is a graph showing the amplitude and shape of the pressure pulses in the drilling fluid as-generated at the pulser (lower curve) and as-received at the surface pressure sensor.

FIG. 9(*a*) is an exploded, isometric view of the pressure sensor shown in FIG. 9.

FIG. 13(*a*) is a view similar to FIG. 13 showing an alternate embodiment of the rotor blade shown in FIG. 13.

DESCRIPTION OF THE PREFERRED EMBODIMENT

Figure 1:
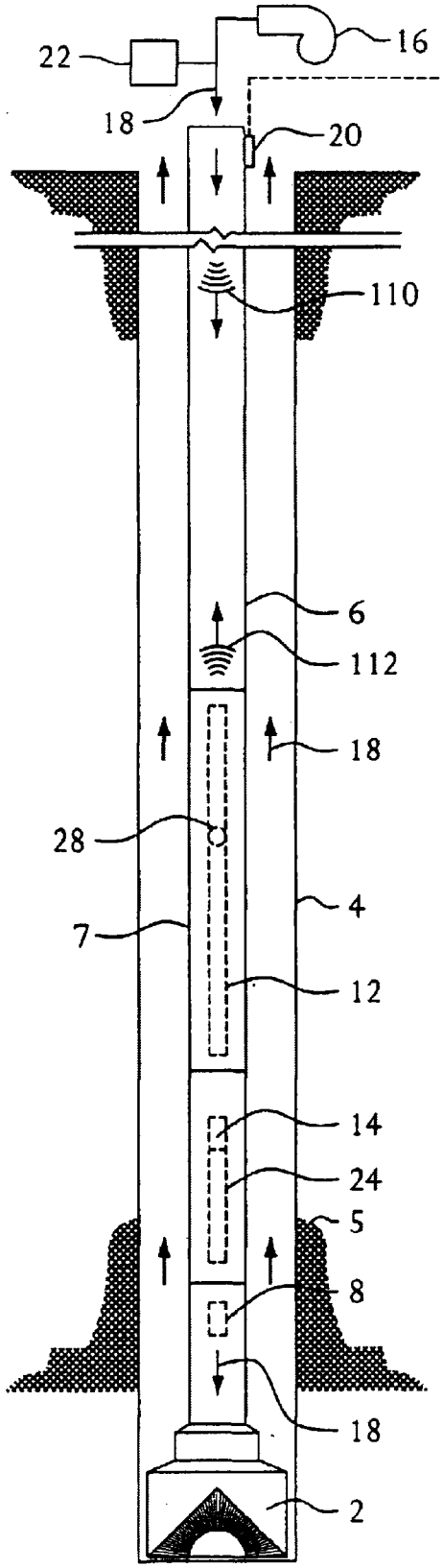
FIG. 1 is a diagram, partially schematic, showing a drilling operation employing the mud pulse telemetry system of the current invention.
Figure 1A:
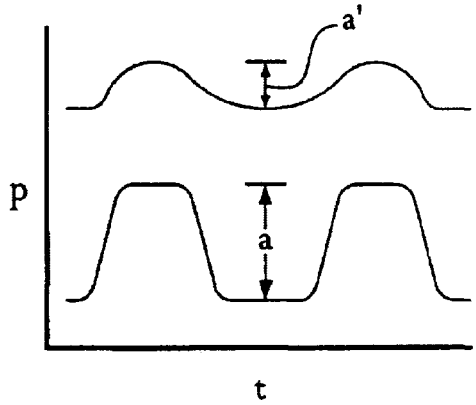

A drilling operation incorporating a mud pulse telemetry system according to the current invention is shown in FIG. 1. A drill bit 2 drills a bore hole 4 into a formation 5. The drill bit 2 is attached to a drill sting 6 that, as is conventional, is formed of sections of piping joined together. As is also conventional, a mud pump 16 pumps drilling mud 18 downward through the drill string 6 and into the drill bit 2. The drilling mud 18 flows upward to the surface through the annular passage between the bore 4 and the drill string 6, where, after cleaning, it is recirculated back down the drill string by the mud pump 16. As is conventional in MWD and LWD systems, sensors 8, such as those of the types discussed above, are located in the bottom hole assembly portion 7 of the drill string 6. In addition, a surface pressure sensor 20, which may be a transducer, senses pressure pulses in the drilling mud 18. According to a preferred embodiment of the invention, a pulser device 22, such as a valve, is located at the surface and is capable of generating pressure pulses in the drilling mud.

Figure 2:
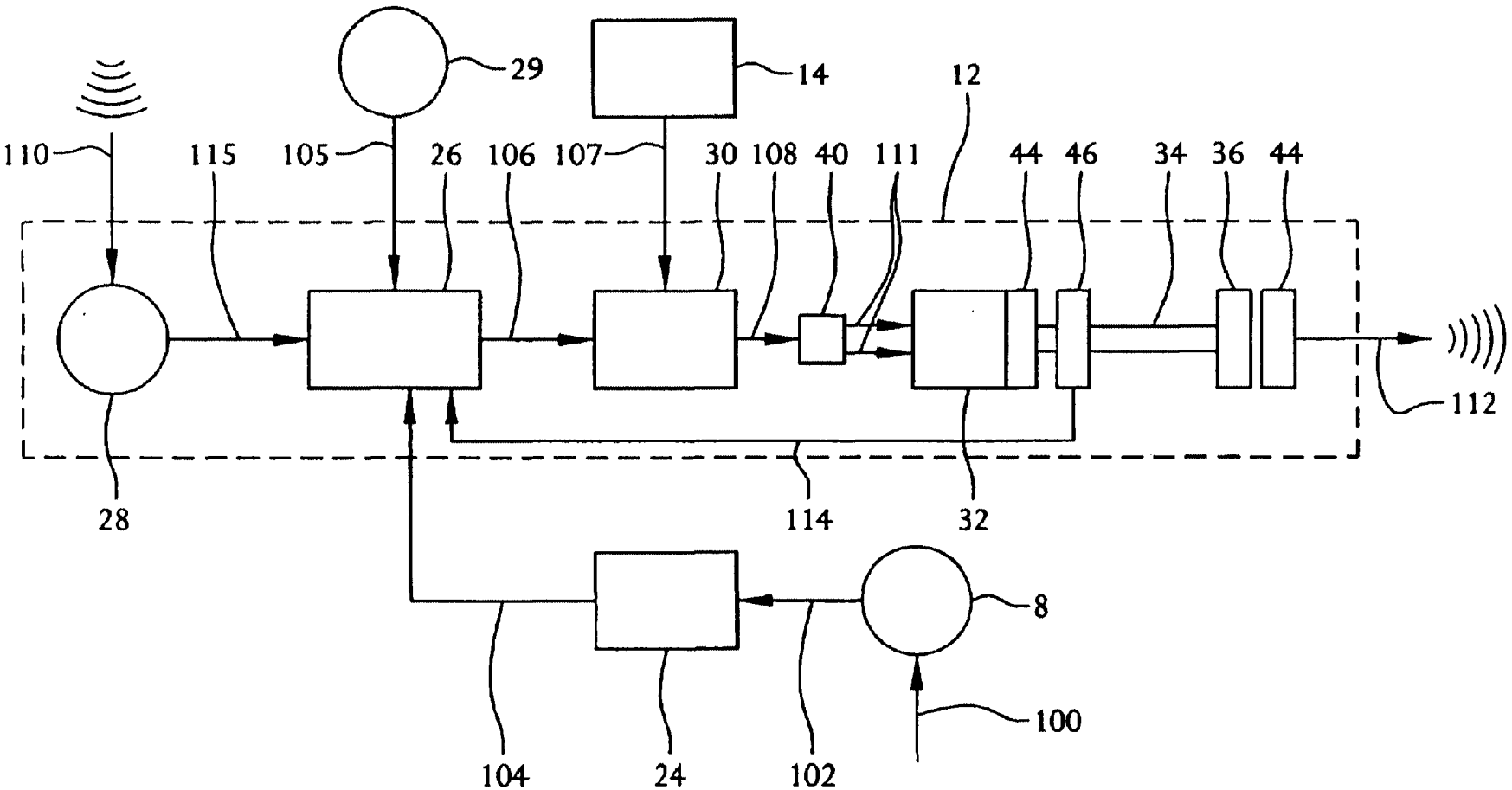
FIG. 2 is a schematic diagram of a mud pulser telemetry system according to the current invention.

As shown in FIGS. 1 and 2, in addition to the sensors 8, the components of the mud pulse telemetry system according to the current invention include a conventional mud telemetry data encoder 24, a power supply 14, which may be a battery or turbine alternator, and a down hole pulser 12 according to the current invention. The pulser comprises a controller 26, which may be a microprocessor, a motor driver 30, which includes a switching device 40, a reversible motor 32, a reduction gear 44, a rotor 36 and stator 38. The motor driver 30, which may be a current limited power stage comprised of transistors (FET's and bipolar), preferably receives power from the power supply 14 and directs it to the motor 32 using pulse width modulation. Preferably, the motor is a brushed DC motor with an operating speed of at least about 600 RPM and, preferably, about 6000 RPM. The motor 32 drives the reduction gear 44, which is coupled to the rotor shaft 34. Although only one reduction gear 44 is shown, it should be understood that two or more reduction gears could also be utilized. Preferably, the reduction gear 44 achieves a speed reduction of at least about 144:1. The sensors 8 receive information 100 useful in connection with the drilling operation and provide output signals 102 to the data encoder 24. Using techniques well known in the art, the data encoder 24 transforms the output from the sensors 8 into a digital code 104 that it transmits to the controller 26. Based on the digital code 104, the controller 26 directs control signals 106 to the motor driver 30. The motor driver 30 receives power 107 from the power source 14 and directs power 108 to a switching device 40. The switching device 40 transmits power 111 to the appropriate windings of the motor 32 so as to effect rotation of the rotor 36 in either a first (e.g., clockwise) or opposite (e.g., counterclockwise) direction so as to generate pressure pulses 112 that are transmitted through the drilling mud 18. The pressure pulses 112 are sensed by the sensor 20 at the surface and the information is decoded and directed to a data acquisition system 42 for further processing, as is conventional. As shown in FIG. 1(*a*), the pressure pulses 112 generated at the down hole pulser 12 have an amplitude "a". However, since the down hole pulser 12 may be as much as 5 miles from the surface, as a result of attenuation, the amplitude of the pressure pulses when they arrive at the surface will be only a'. In addition, the shape of the pulses may be less distinct and noise may be superimposed on the pulses.

Preferably, a down hole static pressure sensor 29 is incorporated into the drill string to measure the pressure of the drilling mud in the vicinity of the pulser 12. As shown in FIG. 2, the static pressure sensor 29, which may be a strain gage type transducer, transmits a signal 105 to the controller 26 containing information on the static pressure.

As is well known in the art, the static pressure sensor 29 may be incorporated into the drill collar of the drill bit 2. However, the static pressure sensor 29 could also be incorporated into the down hole pulser 12.

In a preferred embodiment of the invention, the down hole pulser 12 also includes a down hole dynamic pressure sensor 28 that senses pressure pulsations in the drilling mud 18 in the vicinity of the pulser 12. The pressure pulsations sensed by the sensor 28 may be the pressure pulses generated by the down hole pulser 12 or the pressure pulses generated by the surface pulser 22. In either case, the down hole dynamic pressure sensor 28 transmits a signal 115 to the controller 26 containing the pressure pulse information, which may be used by the controller in generating the motor control signals 106. The down hole pulser 12 may also include an orientation encoder 24 suitable for high temperature applications, coupled to the motor 32. The orientation encoder 44 directs a signal 114 to the controller 26 containing information concerning the angular orientation of the rotor 36, which may also be used by the controller in generating the motor control signals 106. Preferably, the orientation encoder 44 is of the type employing a magnet coupled to the motor shaft that rotates within a stationary housing in which Hall effect sensors are mounted that detect rotation of the magnetic poles.

Figure 3:
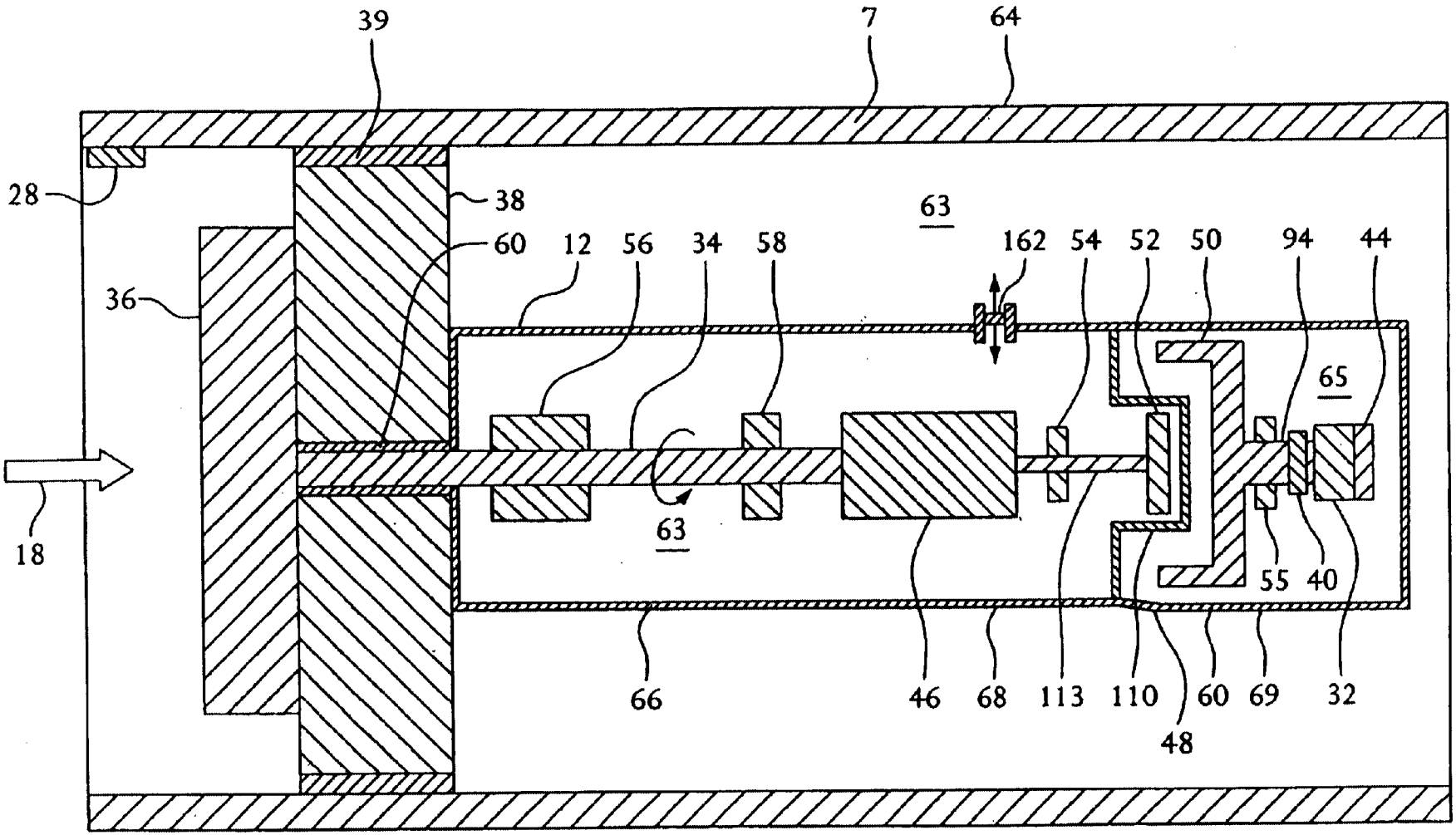
FIG. 3 is a diagram, partially schematic, of the mechanical arrangement of a pulser according to the current invention.

A preferred mechanical arrangement of the down hole pulser 12 is shown schematically in FIG. 3 mounted in a section of drill pipe 64 forming a portion of the bottom hole assembly 7 of the drill string 6. The drill pipe 64 forms a central passage 62 through which the drilling mud 18 flows on its way down hold to the drill bit 2. The rotor 36 is preferably located upstream of a stator 38, which includes a collar portion 39 supported in the drill pipe 64. The rotor 36 is driven by a drive train mounted in a pulser housing. The pulser housing is comprised of housing portions 66, 68, and 69. The rotor 36 includes a rotor shaft 34 mounted on upstream and downstream bearings 56 and 58 in a chamber 63. The chamber 63 is formed by upstream and downstream housing portions 66 and 68 together with a seal 60 and a barrier member 110 (as used herein, the terms upstream and downstream refer to the flow of drilling mud toward the drill bit). The chamber 63 is filled with a liquid, preferably a lubricating oil, that is pressurized to an internal pressure that is close to that of the external pressure of the drilling mud 18 by a piston 162 mounted in the upstream oil-filed housing portion 66.

The rotor shaft 34 is coupled to the reduction gear 46, which may be a planetary type gear train, such as that available from Micromo, of Clearwater, Fla., and which is also mounted in the downstream oil-filled housing portion 68. The input shaft 113 to the reduction gear 46 is supported by a bearing 54 and is coupled to inner half 52 of a magnetic coupling 48, such as that available through Ugimag, of Valparaiso, Ind. The outer half 50 of the magnetic coupling 48 is mounted within housing portion 69, which forms a chamber 65 that is filled with a gas, preferably air, the chambers 63 and 65 being separated by the barrier 110. The outer magnetic coupling half 50 is coupled to a shaft 94 which is supported on bearings 55. A flexible coupling 90 couples the shaft 94 to the electric motor 32, which rotates the drive train. The orientation encoder 44 is coupled to the motor 32. The down hole dynamic pressure sensor 28 is mounted on the drill pipe 64.

In operation, the motor 32 rotates the shaft 94 which, via the magnetic coupling 48, transmits torque through the housing barrier 110 that drives the reduction gear input shaft 113. The reduction gear drives the rotor shaft 34, thereby rotating the rotor 36.

Pressurizing the chamber 63 with oil to a pressure close to that of the drilling mud 18 reduces the likelihood of drilling mud 18 leaking into the chamber 63. In addition, it reduces the forces imposed on the housings portions 66 and 68, which are subject to erosion. Moreover, as discussed further below, in a preferred embodiment of the invention, a novel flexible seal 60 seals between the rotor 36 and the stator 38 at the upstream end of the housing portion 66 to further prevent leakage.

According to one aspect of the current invention, although the rotor 32 and reduction gear 46 are mounted in the oil-filled chamber 63, the motor 32 is mounted in the air filled chamber 65, which is maintained at atmospheric pressure. This allows the use of a brushed reversible DC motor, which is capable of the high efficiency and high motor speeds preferably used according to the current invention. This high efficiency results in consumption of relatively little power, thereby conserving the battery 14. The high speed allows a faster data transmission rate. It also results in a motor drive train with high resistance to rotation which, as discussed below, permits the rotor to maintain its orientation without the use of mechanical stops. Moreover, the use of the magnetic coupling 48 allows the motor 32 to transmit power to the rotor shaft 34 even though the chambers 63 and 65 in which the rotor shaft and motor are mounted are mechanically isolated from each other, effectively eliminating any leakage path between the oil-filled and air-filled chambers. Although in the preferred embodiment, the separate chambers 63 and 65 are formed in contiguous housing portions separated by a barrier 110, the chambers could also be formed in spaced apart housing portions.

Figure 4:
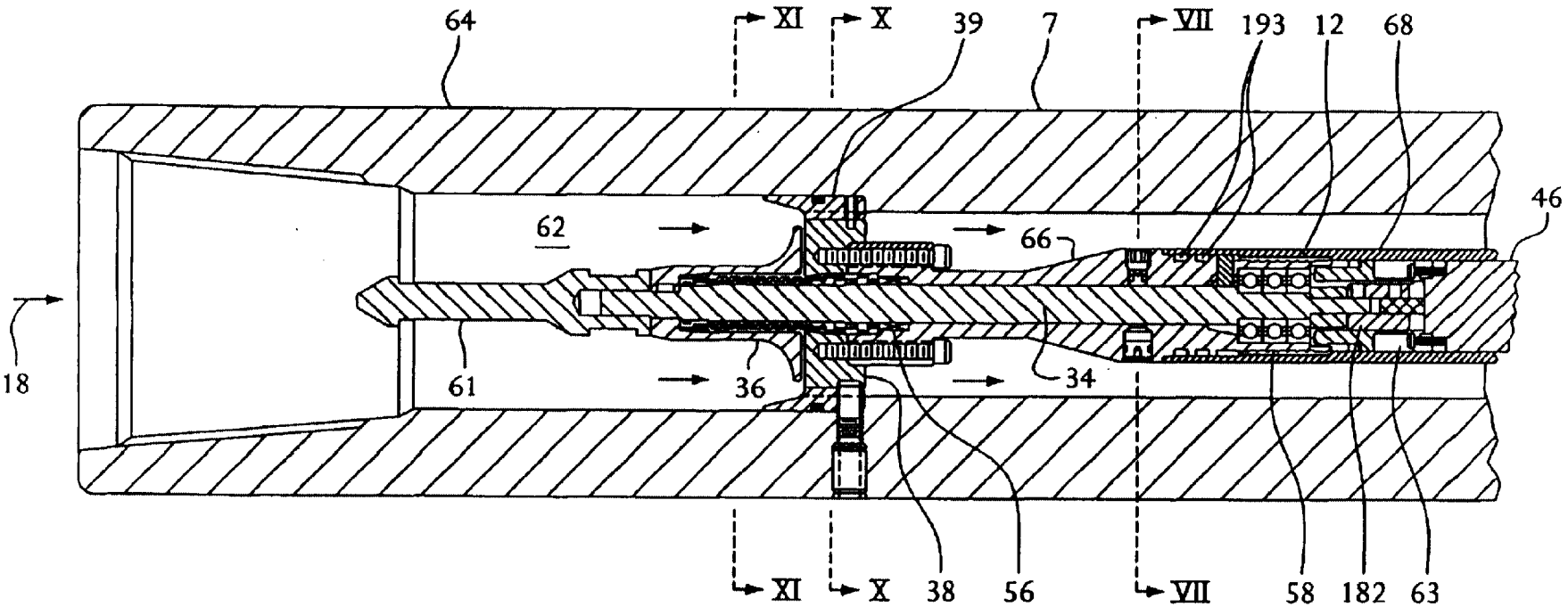
FIGS. 4–6 are consecutive portions of a longitudinal cross-section through a portion of the bottom hole assembly of the drill string shown in FIG. 1 incorporating the pulser shown in FIG. 3.
Figure 5:
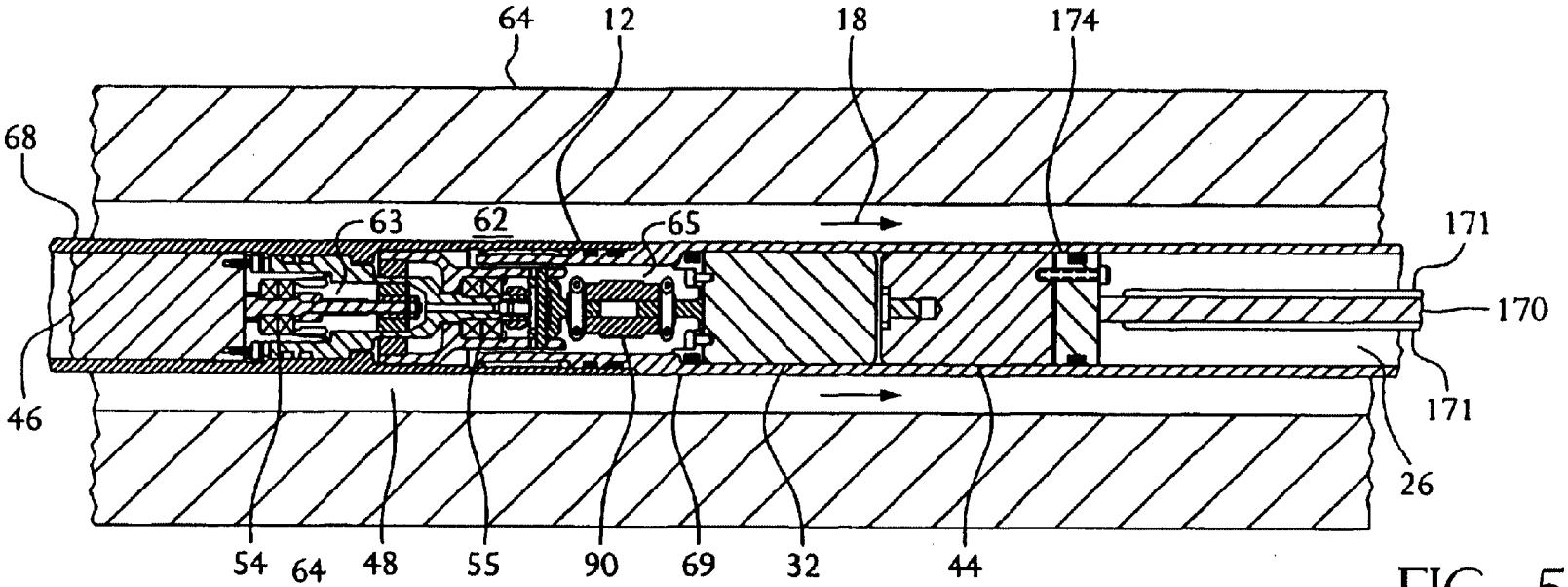
Figure 6:
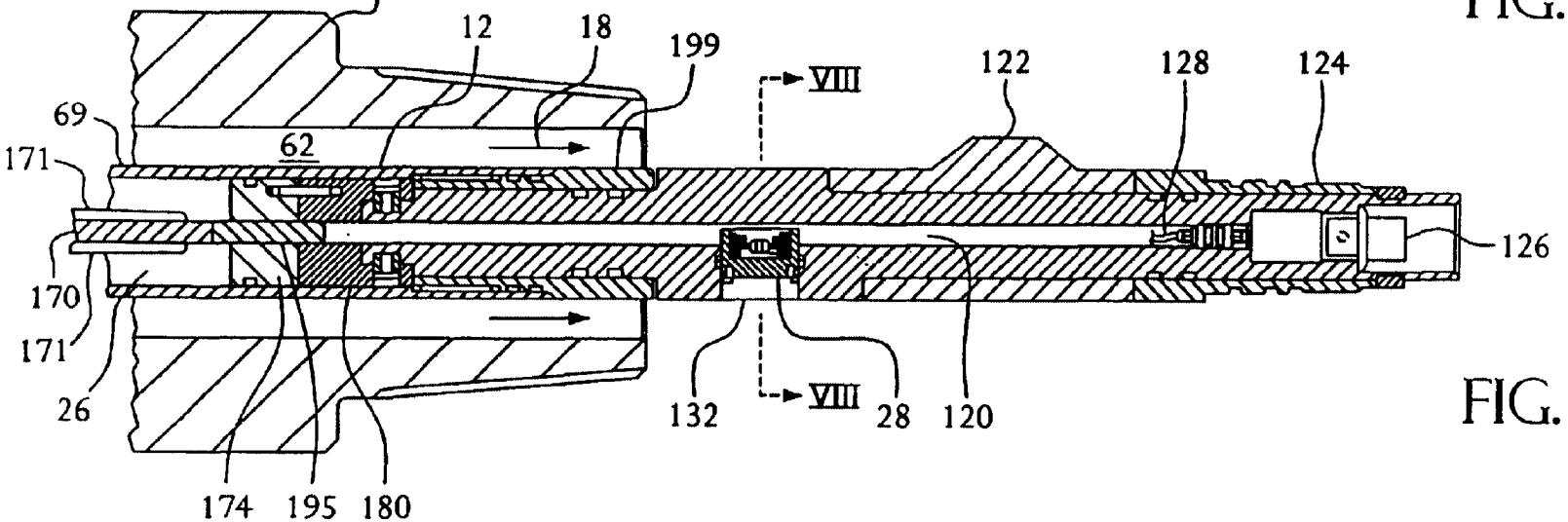

A preferred embodiment of the down hole pulser 12, installed in the bottom hole portion 7 of the drill string 6, is shown in FIGS. 4–14. As previously discussed, the outer housing of the drill string 6 is formed by the section of drill pipe 64, which forms the cental passage 62 through which the drilling mud 18 flows. As is conventional, the drill pipe 64 has threaded couplings on each end, shown in FIGS. 4 and 6, that allow it to be mated with other sections of drill pipe. As shown in FIG. 4, at its upstream end, the down hole pulser 12 is supported within the drill pipe 64 by the stator collar 39. As shown in FIG. 6, the downstream end of the pulser 12 is attached via coupling 180 to a centralizer 122 that further supports it within the passage 62. The stator 38, which is mounted within the stator collar 39, is coupled to the housing portions 66, 68 and 69.

As shown in FIG. 4, the upstream and downstream housing portions 66 and 68 forming the oil filled chamber 63 are threaded together, with the joint being sealed by O-rings 193. The rotor 36 is located immediately upstream of the stator 38 and includes a rotor shaft 34, which is mounted within the oil-filled chamber 63 by the upstream and downstream bearings 58 and 56. A nose 61, which is threaded onto the upstream end of the rotor shaft 34, forms the forward most portion of the pulser 12. The downstream end of the rotor shaft 34 is attached by a coupling 182 to the output shaft of the reduction gear 46.

Figure 7:
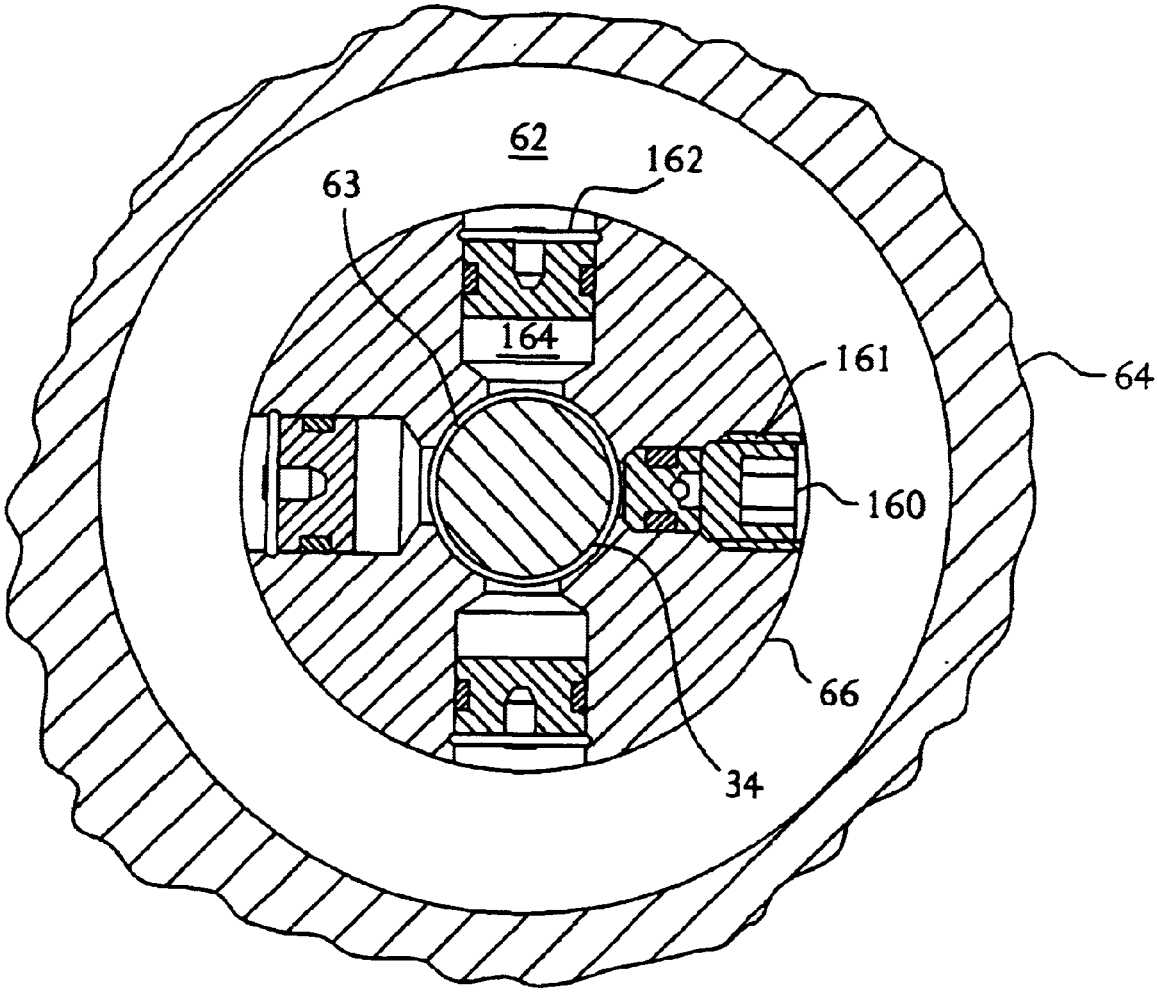
FIG. 7 is a transverse cross-section taken through line VII—VII shown in FIG. 4, showing the pressure compensation system.

As shown in FIG. 7, an opening 161 is formed in housing portion 66 that allows the chamber 63 to be filled with oil, after which the opening 161 is closed by a plug 160. Three pistons 162 slide in cylinders 164 formed in the housing portion 66 to create the pressure equalization system. The drilling mud 18 flowing through the passage 62 displaces the pistons 162 radially inward until the pressure of the oil inside the chamber 63 is approximately equal to that of the outside drilling mud.

Figure 8:
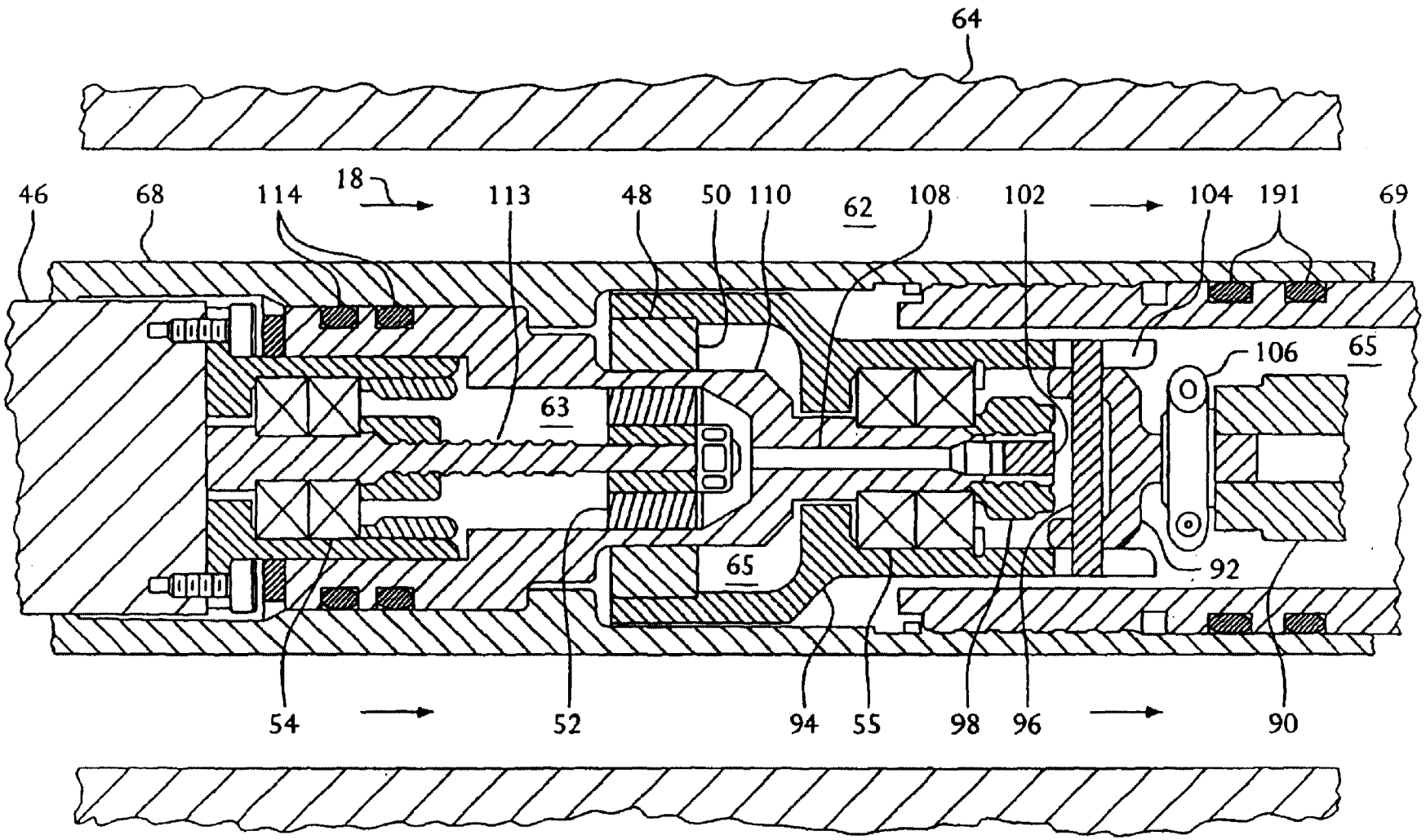
FIG. 8 is a detailed view of the portion of the pulser shown in FIG. 5 in the vicinity of the magnetic coupling.
Figure 9:
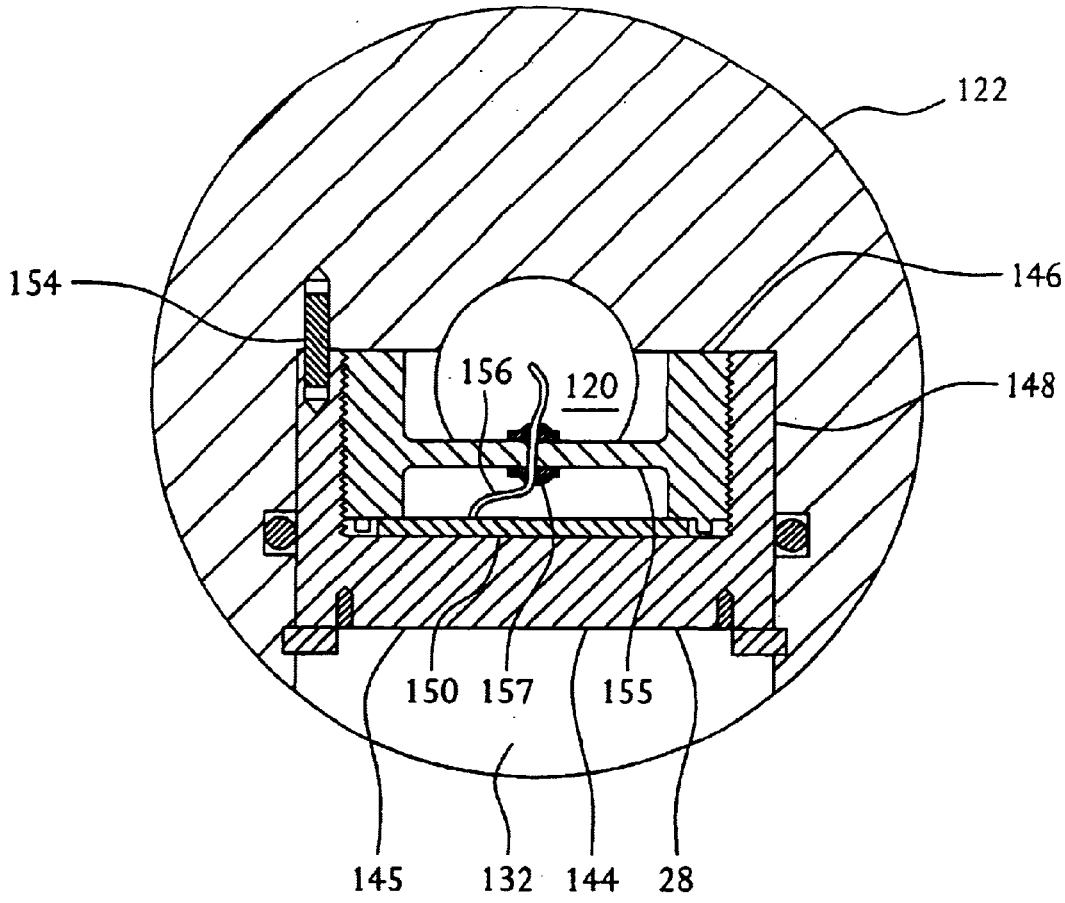
FIG. 9 is a transverse cross-section taken through line IX—IX shown in FIG. 6, showing the pressure sensor.
Figure 9A:
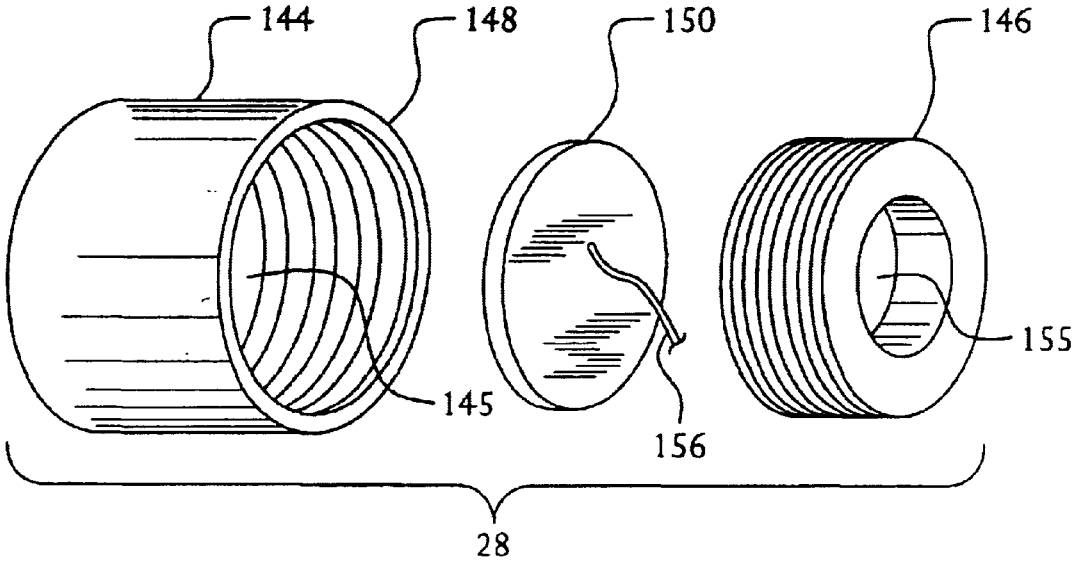

As shown in FIG. 8, the air-filed housing portion 69 is threaded onto the downstream oil-filed housing portion 68, with O-rings 191 sealing the threaded joint. The housing barrier 110 closes the downstream end of the oil-filled housing portion 68, with O-rings 114 providing a seal between the barrier 110 and the housing portion 68. A passage 108 in the barrier 110 facilitates filling the chamber 63 with oil and is thereafter closed with a plug 102. The input shaft 113 of the reduction gear 46 is supported within the housing barrier 110 by the bearings 54 at its upstream end. The inner half 52 of the magnetic coupling 48 is attached to the downstream end of the input shaft 113. The outer half 50 of the magnetic coupling 48 is attached to the upstream portion of shaft 94, which is disposed in the air-filled chamber 65. Thus, although shaft 94 transfers power to shaft 113, there is no physical connection extending through the two chambers that could create a leakage path. Shaft 94 is mounted on bearings 55 supported on the downstream end of the housing barrier 110 and is driven by a clevis 92 and pin 96 that permits axial displacement between the two halves of the shafting. The clevis 92 is attached by a clamp 106 to a flexible coupling 90, which accommodates radial misalignment of the components.

As shown in FIG. 5, the motor 32 and orientation encoder 44 are also mounted within the air-filled chamber 65 formed by the housing portion 69, with the output shaft of the motor 32 being coupled to the clevis 92 via the flexible coupling 90. As shown in FIGS. 5 and 6, the controller 26 is comprised of a central support plate 170 on which printed circuit boards are mounted, such as printed circuit boards 171. The support plate 170 is supported on upstream and downstream ends 174 that are supported within the housing portion 69 and sealed by O-rings. The downstream support end 174 is coupled to an adapter 180 that mates to the upstream end of the centralizer 122. A housing 199 is threaded onto the downstream end of the housing portion 69 and mates with the centralizer 122. O-rings seal both the joint between the housing portion 69 and housing 199 and the joint between the housing 199 and the centralizer 122.

The printed circuit boards 171 contain electronics components that are programed with associated information and soft-ware for operating the pulser 12. Such software will include that necessary to translate the digital code from the data encoder 24 into operating instructions for the motor 32. In some embodiments, this software will also include that necessary to analyze the signals from the down hole static pressure sensor 29 and/or the orientation encoder 44 and/or the dynamic down hole pressure sensor 28, including that required to decipher encoded instructions from the surface that are received by the down hole dynamic sensor, and to control the operation of the motor 32 based on these signals, as explained further below. The creation of such software is well within the routine capabilities of those skilled in the art, when armed with the teachings disclosed herein.

A coupling 124 is formed on the downstream end of the centralizer 122 that allows it to be mechanically coupled with other portions of the bottom hole assembly 7, which include the power supply 14 and data encoder 24. An electrical connector 126 is mounted at the downstream end of the centralizer that allows the down hole pulser 12 to receive electrical signals from the power supply and data encoder 24. A central passage 120 in the centralizer 122 allows conductors 128 from the connector 126 to extend to a connector 195 for the pulser 12, which are then transmitted to the controller 26 via conductors, not shown.

As shown in FIG. 6, the down hole dynamic pressure sensor 28 is mounted in a recess 132 in the centralizer section 122, although other locations could also be utilized. As shown best in FIGS. 9 and 9(*a*), the down hole dynamic pressure sensor 28 is comprised of a diaphragm 144 formed by a circular face portion 145 and a rearwardly extending cylindrical skirt portion 148. The diaphragm 144 must be sufficiently strong to withstand the pressure of the drilling mud 18, which can be as high as 25,000 psi. However, it should also have a relatively low modulus of elasticity so as to be sufficiently elastic to dynamically respond to the pressure pulsations, the magnitude of which may be low at the pressure sensor 28. Preferably, the diaphragm 144 is formed from titanium. Threaded holes are formed in the front surface of the diaphragm face 145 to facilitate removal of the sensor assembly 28.

The piezoelectric element 150 is mounted adjacent, and in surface contact with, the diaphragm 144. While piezoelectric elements can be made from a variety of materials, preferably, the piezoelectric element 150 is a piezoceramic element, which has a relatively high temperature capability (by contrast, piezoplastics, for example, cannot be used at temperatures in excess of 150° F.) and creates a relatively high voltage output when subjected to a minimum amount of strain. According to the piezoelectric phenomenon, certain crystalline substances, such as quartz and come ceramics, develop an electrical field when subjected to pressure. The piezoceramic element 50 according to the invention is preferably formed by forming a dielectric material, such as lead Metaniebate or lead zirconate titanate, into the desired shape, in this case, a thin disk. Electrodes are then applied to the material. The dielectric material is heated to an elevated temperature in the presence of a strong DC electric field, which polarizes the ceramic so that the molecular dipoles are aligned in the direction of the applied field, thereby imparting dielectric properties to the element. A piezoceramic element 150 has several attributes that make it especially suitable for down hole pressure pulsation sensing. It is compact. In one embodiment of a pressure pulsation sensor 16, the piezoceramic element 50 is approximately only 0.8 inch in diameter and 0.02 inch thick. Piezoelectric elements consume relatively little electric power compared to strain gage based pressure transducers. Also, unlike strain gage based pressure transducers, the piezoceramic element 150 is not affected by static pressure, which would otherwise create a DC offset, because the voltage change that occurs when a piezoceramic element is stressed is transient, returning to zero in a short time even if the stress is maintained. Suitable piezoceramic elements are available from Piezo Kinetics Incorporated, Pine Street and Mill Road, Bellefonte, Pa. 16823.

The dynamic pressure sensor 28 also includes a plug 146 mounted behind the piezoceramic element 50. The plug 146 is preferably formed from an electrically insulating material, such as a thermoplastic. It has external threads formed on its outside surface that mate with internal threads formed on a skirt portion of the diaphragm 144. A dowel pin 154 is disposed in mating holes prevents rotation of the sensor assembly 28.

In the preferred embodiment of the current invention, the piezoceramic element 150 is maintained in intimate surface contact with the diaphragm 144 by compressing the edges of the element between the rear face of the diaphragm and the plug 146. The plug 146 is threaded into the diaphragm skirt 148 so that it rests on the piezoelectric element 150, not the rear surface of the diaphragm face 145, thereby leaving a gap between the plug and the diaphragm face. In operation, the high pressure of the drilling mud causes static deflection of the diaphragm face 145, while pressure pulsations in the drilling mud cause vibratory deflection of the diaphragm face. Compressing the edges of the ceramic element 150 against the face of the diaphragm 144 ensures that the ceramic element will undergo vibratory deflections in response to vibratory deflections of the diaphragm face 145, thereby enhancing the sensitivity of the sensor.

However, although the compressive force supplied by the plug 146 is sufficient to restrain the piezoceramic element 150 axially—that is, in the direction parallel to the axis of the diaphragm skirt 148—it does not prevent relative sliding motion of the piezoceramic element in the radial direction—that is, in the plane of the element 150. This prevents the piezoceramic element 150 from experiencing a large, static, tensile strain as a result of the static deflection of the diaphragm face 145, such as would occur if the piezoceramic element 150 were glued or otherwise completely restrained with respect to the diaphragm face 145. Such large tensile strains could result in failure of the piezoelectric element 150, which is relatively brittle. In one embodiment of the invention, the plug 146 is threaded into the diaphragm skirt 148 so as to apply a 100 pound preloaded to the piezoelectric element 150.

In operation, the high pressure of the drilling mud 18 causes static deflection of the diaphragm face 145, while pressure pulsations in the drilling mud cause vibratory deflection of the diaphragm face which are transmitted to the piezoceramic element 150. These vibratory deflections cause the voltage from the piezoceramic element 150 to varying in proportion to the deflection.

The conductor lead 156 from the piezoceramic element 150 extends through a potted grommet 157 on an intermediate support plate 155 formed in the plug 146, and then through the passage 120 in the centralizer 122 before terminating at the controller 26. As previously discussed, the printed circuit boards 171 of the controller 26 incorporate the electronics and software necessary to receive and analyze the voltage signal from the piezoceramic element 50—for example, so as to determine the amplitude of the pressure pulses generated by the pulser 12 or to decode other instructions from the surface for operation of the pulser.

Figure 10:
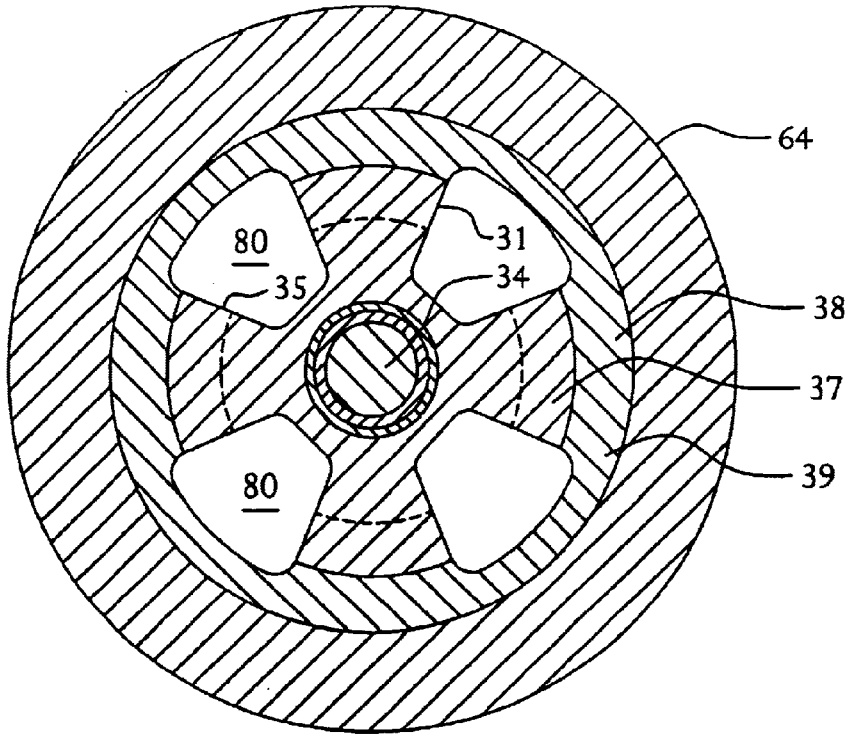
FIG. 10 is a transverse cross-section taken through line X—X shown in FIG. 4, showing the stator.

The construction and operation of the rotor 36 and stator 38 are shown in more detail in FIGS. 10–14. As shown in FIG. 10, the stator 38 is comprised of the collar 39 and an inner member 37. Radially extending vanes 31 form axially extending passages 80 that are spaced circumferentially around the stator 38. When the passages 80 are unobstructed, they allow drilling mud 18 to flow through the pulser 12 with minimum pressure drop. The rotor 36 is comprised of a sleeve 33 mounted by a key onto the rotor shaft 34 and from which blades 35 extend radially. Although four stator passages 80 and four rotor blades 35 are illustrated, other quantities of stator passages and rotor blades could also be used.

As discussed in detail below, preferably, the down hole pulser 12 operates by oscillating rotational motion—rotating first in one direction and then in an opposite direction. This mode of operation prevents flow blockages and jams. In a system that uses continuous rotation in a single direction, it is possible for a piece of debris to become lodged between the rotor and stator. This will have the effect of jamming the rotor and simultaneously obstructing one of the passages for the flow of drilling mud. In the current invention, any such obstruction will be alleviated during the normal course of operation, without disruption of data transmission, because reversal of the direction of rotor rotation during the next cycle will free the debris, allowing it to be carried away by the flow of drilling mud. This effect can be enhanced by shaping the rotor blades so that the clearance between the rotor and stator are increased when rotation occurs in one direction, as discussed below.

Figure 11:
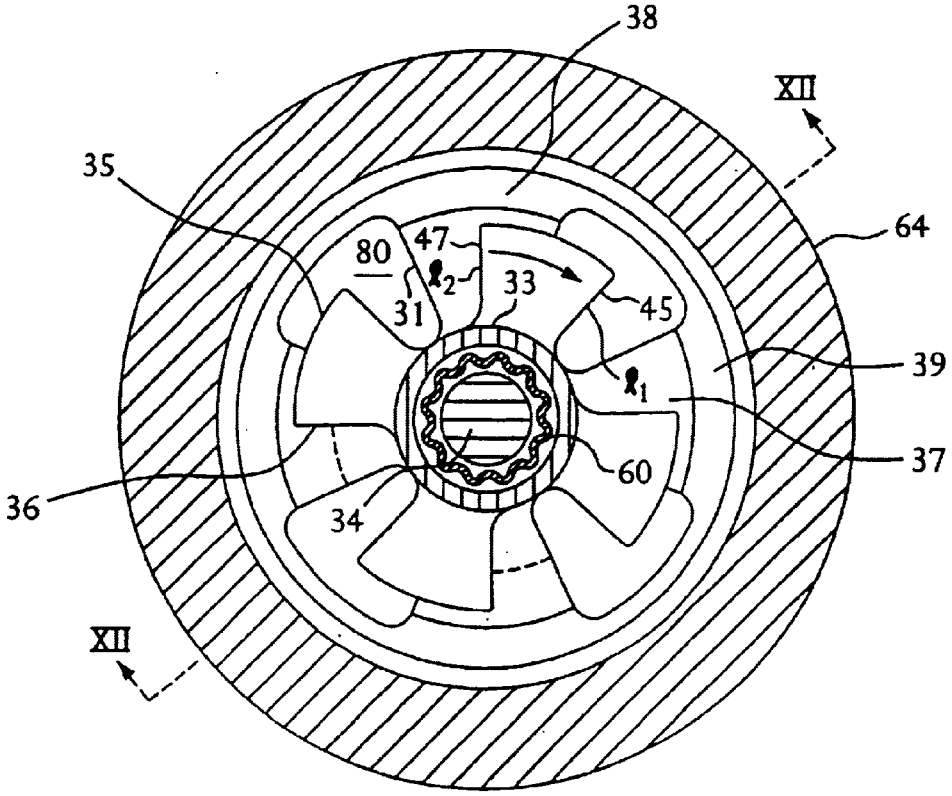
FIG. 11 is a transverse cross-section taken through line XI—XI shown in FIG. 4, showing the rotor and stator.
Figure 13:
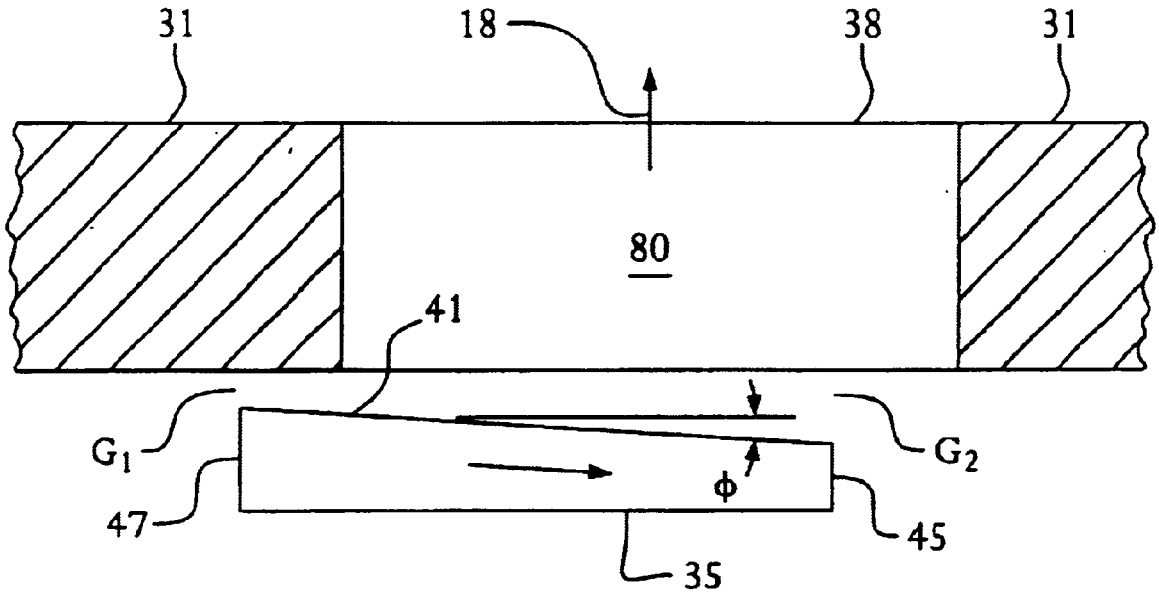
FIG. 13 is a cross-section taken along line XIII—XIII shown in FIG. 12 showing portions of the rotor and stator.
Figure 13A:
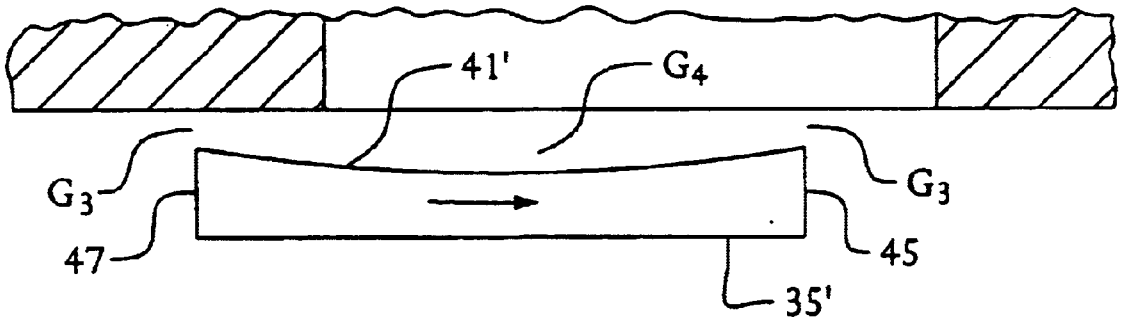

According to the preferred embodiment, the radial length $l_2$ of one of the edges 47 of each of the rotor blades 35, shown as the trailing edge in FIG. 11, is slightly longer than the radial length $l_1$ of the opposite edge 45, shown as the leading edge FIG. 11—it should be appreciated that which edges are leading and trailing reverses each time the direction of rotation of the rotor reverses. Preferably, $l_2$ is about 0.010 inch longer than $l_1$. In addition, as shown in FIG. 13, the downstream face 41 of each of the rotor blades 35 is preferably oriented at an angle $\phi$ with respect to the upstream face of the stator 38 so that the circumferential gap G by which the rotor blades are axially displaced from the stator increases from edge 47 to edge 45. Preferably, the angle $\phi$ is at least about 5° so that the gap $G_2$ at edge 45 is at least about 0.040 inch larger than the gap $G_1$ at edge 47, with $G_1$ preferably being about 0.080 inch. These two features—the unequal edge length and unequal axial gap—prevent jamming of the rotor since any debris trapped between the stator 38 and a rotor blade 35 during rotation in one direction will tend to be automatically dislodged when the rotor reverses its direction of rotation during the next cycle since such reversal will increase the radial and axial clearance between the rotor blades 35 and the stator 38 and thus allow the drilling fluid 18 to wash away the debris.

In an alternate embodiment, the downstream face 41' of the rotor blade is concave, as shown in FIG. 13(*a*), so that any debris sufficiently small to pass between the axial gap $G_3$ between the edges 45 and 47 of the blades 35' and the stator 38 will end up being lodged in an area of increased axial gap $G_4$ and, thus, less likely to prevent rotation of the rotor.

Figure 12:
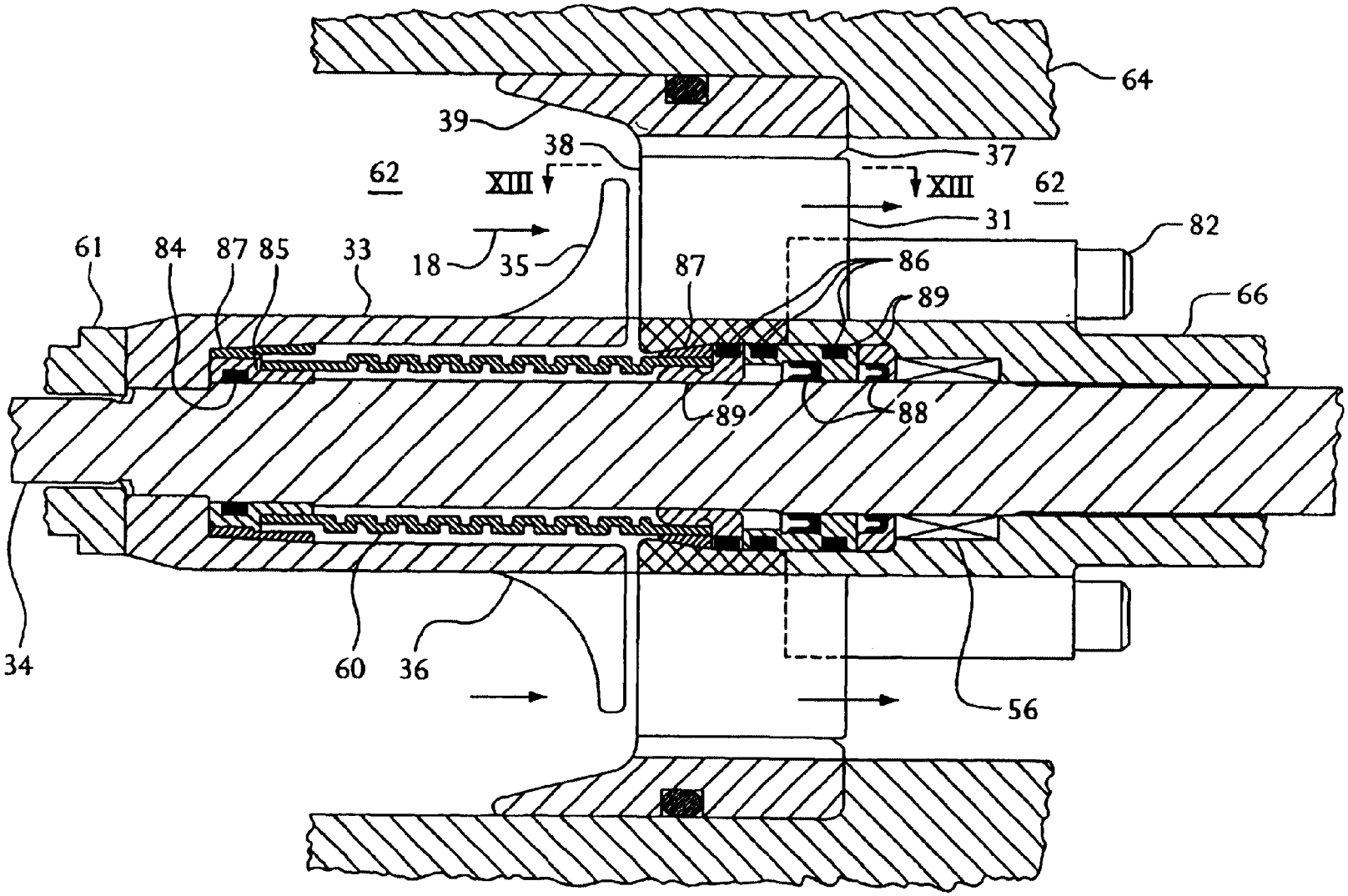
FIG. 12 is a longitudinal cross-section taken through line XII—XII shown in FIG. 11 showing the rotor and stator.

As shown in FIG. 12, a novel annular seal 60 extends from the upstream end of the rotor 33 to the stator 38. As a result of the pressure equalization system, described above, the pressure is approximately the same both inside and outside of the seal 60. The upstream end of the seal 60 is secured by an interference fit onto a ring 85, which, in turn, is press fit into the rotor sleeve 33 by a shim 87. An O-ring 84 provides a seal between the ring 85 and the rotor shaft 34. Note that although it rotates along with the rotor 36, the O-ring 84 is considered a "stationary seal" because there is no relative rotation between the two members across which the seal is formed, in this case, the ring 85 and the rotor shaft 34. Similarly, the downstream end of the seal 60 is press fit into the bore of the stator 38 by another shim 87. O-rings 86 mounted in stationary seal rings 89 form stationary seals between the seal rings 89 and the stator 38. In the illustrated embodiment, rotating seals 88 are mounted in the two downstream stationary seal rings 89 and form "rotating" seals between the rotating rotor shaft 34 and the stationary stator 38. However, in many applications, the rotating seals 88 could be dispensed with so that there were no rotating seals and sealing accomplished exclusively with stationary seals—that is, seals between components that did not "rotate" relative to each other.

Figure 14A:
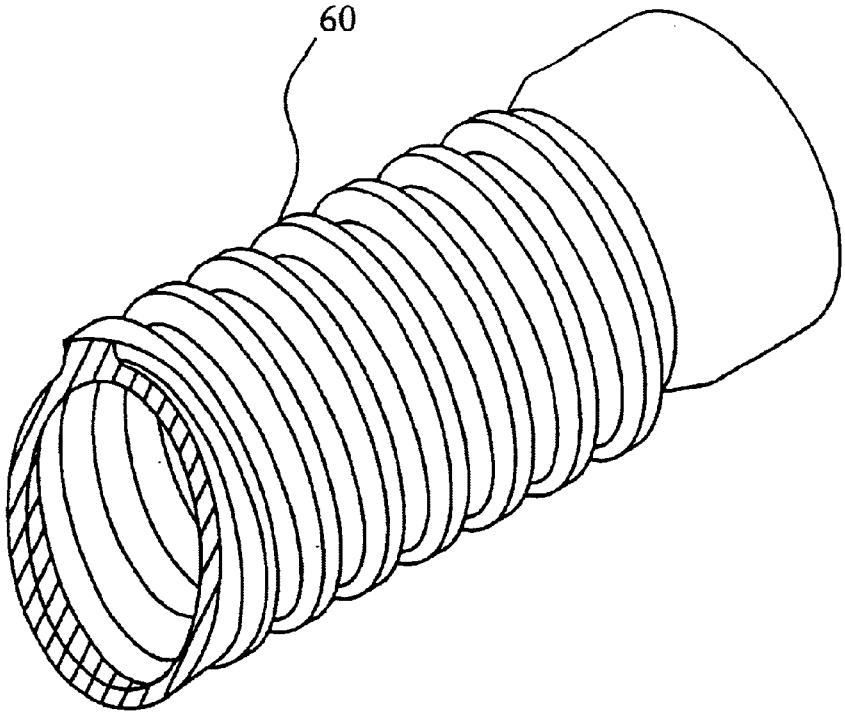
FIGS. 14(*a*) and (*b*) are isometric views of two embodiments of the seal shown in FIG. 12.
Figure 14B:
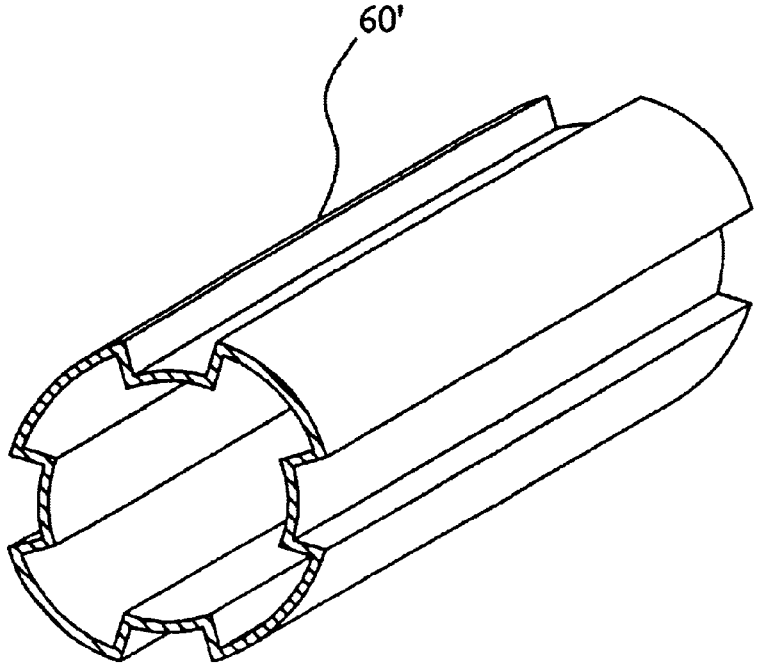

According to a preferred embodiment of the current invention, the seal 60 is generally cylindrical and preferably has helically extending corrugations so as to form a bellows type construction to facilitate torsion deflection without buckling, as well as axial expansion, as shown in FIG. 14(*a*). Alternatively, a seal 60' having axial corrugations, which facilitate torsional deflection, could be employed, as shown in FIG. 14(*b*). The seal 60 is preferably made from a resilient material, such as an elastomer, most preferably nitrile rubber, that is able to withstand the torsional deflects resulting from repeated angular oscillations—for example, through an angle of 45° associated with the operation of the rotor 36, discussed below. Note that since the rotor 36 does not create pressure pulses by continuously rotating in a given direction, but rather by rotating in a first direction and then reversing and rotating in the opposite direction so as to only oscillate, conventional rotating seals can be dispensed with, as discussed above.

Figure 15A:
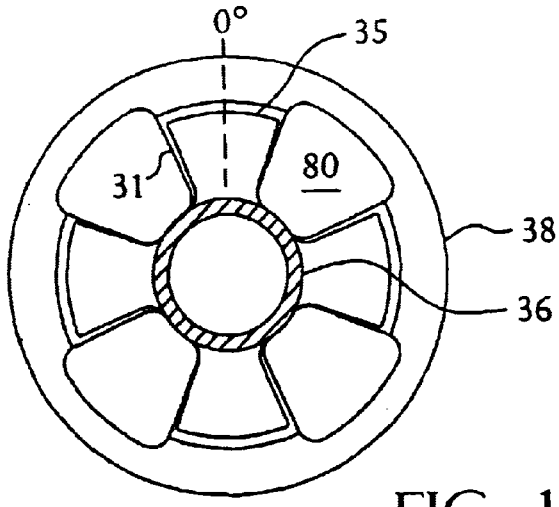
FIGS. 15(*a*)–(*c*) show the rotor in three orientations relative to the stator.
Figure 15B:
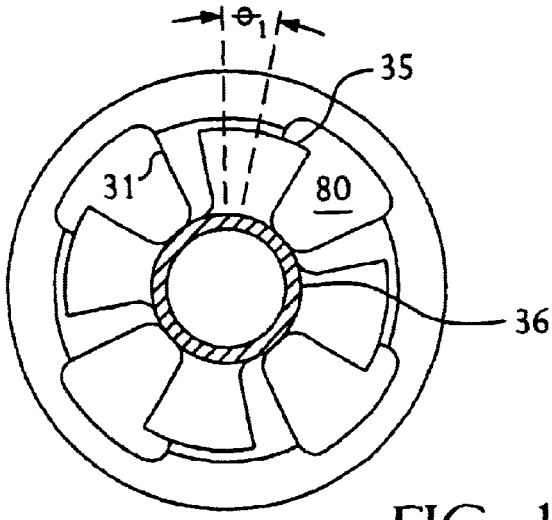
Figure 15C:
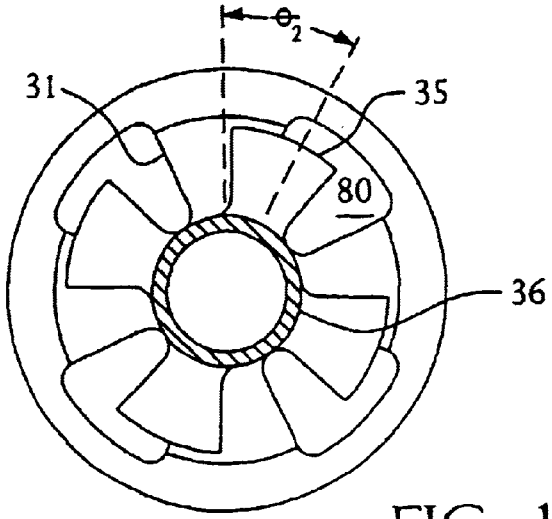
Figure 16:
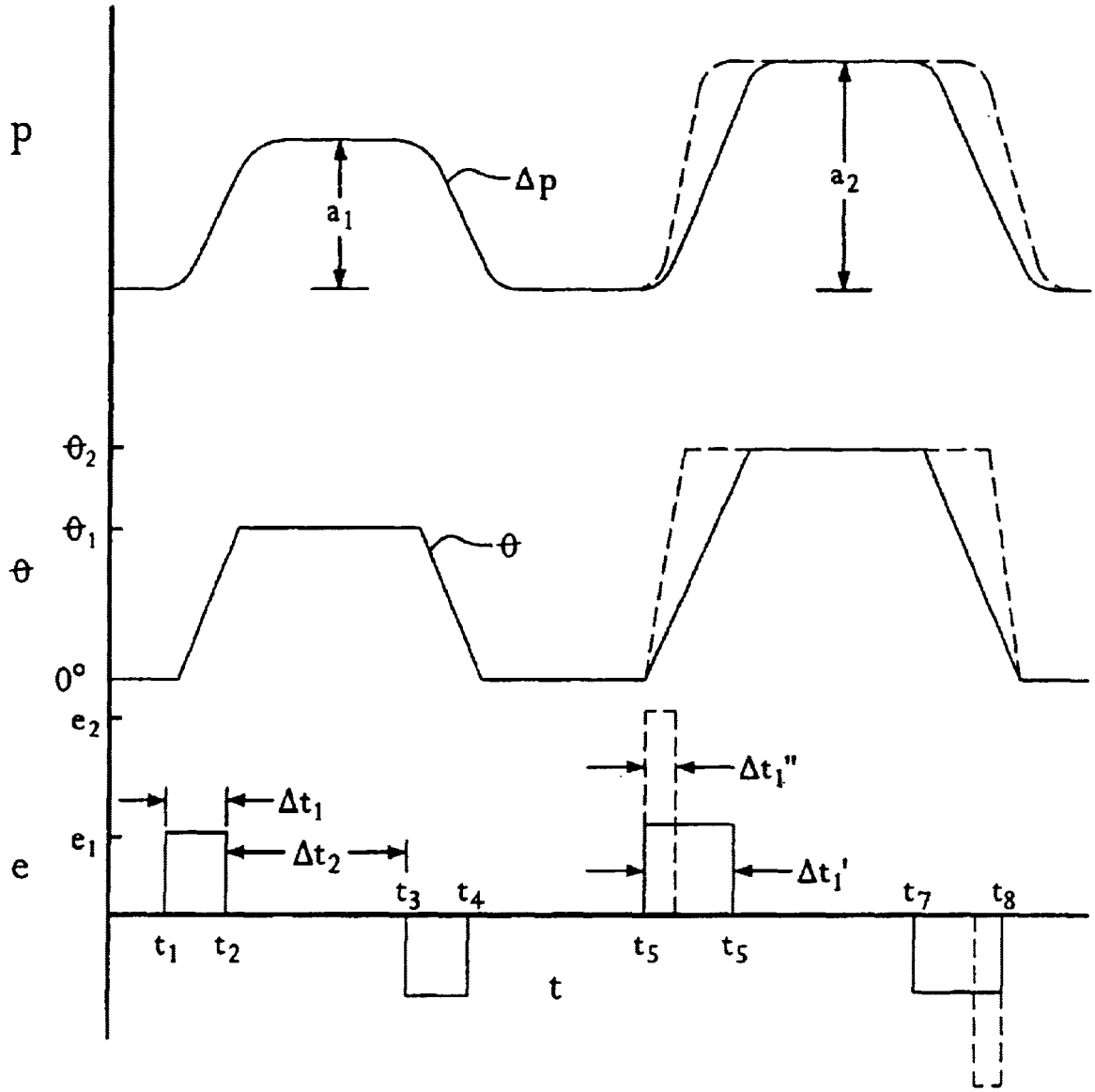
FIG. 16 is a graph showing the timing relationship of the electrical power e transmitted from the motor driver to the motor (lower curve) to the angular orientation of the rotor θ (middle curve) and the resulting pressure pulse ΔP generated at the pulser (upper curve).

The operation of the rotor 36 according to the current invention, and the resulting pressure pulses in the drilling mud 18 are shown in FIGS. 15 and 16, respectively. Preferably, the circumferential expanse of the rotor blades 35 is about the same as, or slightly less than, that of the stator vanes 31. Thus, when the rotor 36 is a first angular orientation, arbitrarily designated as the 0° orientation in FIG. 15(*a*), the rotor blades 35 provide essentially no obstruction of the flow of drilling mud 18 through the passage 80, thereby minimizing the pressure drop across the pulser 12. However, when the rotor 36 has been rotated in the clockwise direction by an angle $\theta_1$, the rotor blades 35 partially obstruct the passages 80, thereby increasing the pressure drop across the pulser 12. (Whether a circumferential direction is "clockwise" or "counterclockwise" depends on whether the viewer is oriented upstream or downstream from the pulser 12.

Therefore, as used herein, the terms clockwise and counterclockwise are arbitrary and intended to convey only opposing circumferential directions.) If the rotor 36 is thereafter rotated back to the 0° orientation, a pressure pulse is created having a particular shape and amplitude $a_1$, such as that shown in FIG. 16. If, in another cycle, the rotor 36 is rotated further in the circumferential direction from the 0° orientation to angular orientation $\theta_2$, the degree of obstruction and, therefore, the pressure drop will be increased, resulting in a pressure pulse having another shape and a larger amplitude $a_2$, such as that also shown in FIG. 16. Therefore, by adjusting the magnitude and speed of the rotational oscillation $\theta$ of the rotor 36, the shape and amplitude of the pressure pulses generated at the pulser 12 can be adjusted. Further rotation beyond $\theta_2$ will eventually result a rotor orientation providing the maximum blockage of the passage 80. However, in the preferred embodiment of the invention, the expanse of the rotor blades 35 and stator passages 80 is such that complete blockage of flow is never obtained regardless of the rotor orientation.

The control of the rotor rotation so as to control the pressure pulses will now be discussed. In general, the controller 26 translates the coded data from the data encoder 24 into a series of discrete motor operating time intervals. For example, as shown in FIG. 16, in one operating mode, at time $t_1$, the controller 26 directs the motor driver 30 to transmit an increment of electrical power of amplitude $e_1$ to the motor 32. After a short time lag, due to inertia, the motor 32 will begin rotating in the circumferential direction, thereby rotating the rotor 36, which is assumed to initially be at the 0° orientation, in the same direction.

At time $t_2$, after an elapse of time interval $\Delta t_1$, the controller will direct the motor driver 30 to cease the transmission of electrical power to the motor 32 so that, after a short lag time due to inertia, the rotor 36 will stop, at which time it will have reached angular orientation $\theta_1$, which, for example, may be 20°, as shown in FIG. 15(*b*). This will result in an increase in the pressure sensed by the surface sensor 20 of $a_1$. At time $t_3$, after an elapse of time interval $\Delta t_2$, the controller 26 directs the motor driver 30 to again transmit electrical power of amplitude $e_1$ to the motor 32 for another time interval $\Delta t_1$, but now in the opposite—that is, the counterclockwise—direction, so that the rotor 36 returns back to the 0° orientation, thereby returning the pressure to its original magnitude. The result is the creation of a discrete pressure pulse having amplitude $a_1$. Generally, the shape of the pressure pulse will depend upon the relative lengths of the timer intervals $\Delta t_1$ and $\Delta t_2$ and the speed at which the rotor moved between the 0° and $\theta_1$ orientations—the faster the speed, the more square-like the pressure pulse, the slower the speed, the more sinusoidal the pressure pulse.

It will be appreciated that the time intervals $\Delta t_1$ and $\Delta t_2$ may be very short, for example, $\Delta t_1$ might be on the order of 0.18 second and $\Delta t_2$ on the order of 0.32 seconds. Moreover, the interval $\Delta t_2$ between operations of the motor could be essentially zero so that the motor reversed direction as soon as stopped rotating in the first direction.

After an elapse of another timer interval, which might be equal to $\Delta t_2$ or a longer or shorter time interval, the controller 26 will again direct the motor driver 30 to transmit electrical power of $e_1$ to the motor 32 for another time interval $\Delta t_1$ in the clockwise direction and the cycle is repeated, thus generating pressure pulses of a particular amplitude, duration, and shape and at particular intervals as required to transmit the encoded information.

The control of the characteristics of the pressure pulses, including their amplitude, shape and frequency, afforded by the present invention provides considerably flexibility in encoding schemes. For example, the coding scheme could involve variations in the duration of the pulses or the time intervals between pulses, or variations in the amplitude or shape of the pulses, or combinations of the foregoing. In addition to allowing adjustment of pressure pulse characteristics (including amplitude, shape and frequency) to improve data reception, a more complex pulse pattern could be also be effected to facilitate efficient data transmission. For example, the pulse amplitude could be periodically altered—e.g., every third pulse having an increased or decreased amplitude. Thus, the ability to control one or more of the pressure pulse characteristics permits the use of more efficient and robust coding schemes. For example, coding using a combination of pressure pulse duration and amplitude results in fewer pulses being necessary to transmit a given sequence of data.

Although the rotational movement of the rotor in each direction necessary to create a pressure pulse discussed above was effected by a continuous transmission of electrical power e so as to energize the motor over time interval $\Delta t_1$, in order to minimize power consumption, the motor could also be energized over time interval $\Delta t_1$ by transmitting a series of very short duration power pulses, for example on the order of 10 milliseconds each, that spanned time interval $\Delta t_1$ so that, after the initial pulse of electrical power, each pulse of electrical power during $\Delta t_1$ was transmitted while the rotation of the motor was coasting down, but had not yet stopped, from the previous transmission a pulse of electrical power.

As discussed above, the controller 26 could direct power to the motor 32 over a predetermined time interval $\Delta t_1$ so as to result in an assumed amount of rotation $\theta$. Alternatively, the controller could control one or more characteristics of the pressure pulses by making use of information concerning the angular orientation of the rotor 36, such as the angular orientation itself or the change in angular orientation, provided by the orientation encoder 44. This allows the controller 26 to operate the motor until a predetermined angular orientation, or change in angular orientation, was achieved. For example, the controller 26 could rotate the motor continuously until a given orientation was reached and then cease operation, if necessary taking into account inertia in the system to estimate the final orientation achieved. Or the controller 26 could repeatedly rotate the motor over discrete short time intervals until the orientation encoder 44 indicated that the desired amount of rotation had been obtained.

Significantly, according to one aspect of the current invention, as a result of the resistance to rotation by the rotor drive train, ceasing rotation of the motor 32 will cause the rotor 36 to remain at angular orientation $\theta_1$ throughout the time period $\Delta t_2$. Thus, the magnitude of the angular oscillation of the rotor 36 is set without the use of mechanical stops to stop rotation of the rotor at a predetermined location. Nor are stops used to maintain the rotor 36 in a given orientation. Such stops, when used continuously, are a source of wear and failure. Nevertheless, mechanical safety stops could be utilized to ensure that rotation beyond a maximum amount, such as that capable of being safety accommodated by the seal 60, did not occur.

Significantly, the control over the characteristics of the pressure pulses afforded by the current invention allows adjustment of these characteristics in situ in order to optimize data transmission. Thus, it is not necessary to cease drilling and withdraw the pulser in order to adjust the amplitude, duration, shape or frequency of the pressure pulses as would have been required with prior art systems.

Operation in the mode discussed above can be continued so that the pulser 12 continuously oscillates over angle θ1, generating a series of pressure pulses the amplitude, shape, duration and frequency of which is set by the timing of the signals operating the motor.

However, after a period of time, one or more of the characteristics of the pressure pulses thus generated may create problems in terms of data reception at the surface pressure sensor 20. This can occur for a variety of reasons, such as a change in mud flow conditions (such as flow rate or viscosity), or an increase in the distance between the pulser 12 and the surface pressure sensor 20 as drilling progresses, thereby increasing pressure pulse attenuation, or the introduction of noise or other sources of pressure pulsations into the drilling mud. According to the current invention, the controller 26 will then direct the motor driver 30 to alter one or more characteristics of the pressure pulses as appropriate.

For example, the amplitude of the pressure pulses could be increased by increasing the time interval $\Delta t_1'$ during which the motor operates (for example, by increasing the duration over which electrical power of amplitude $e_1$ is transmitted to the motor). The increased motor operation increases the amount of rotation of the rotor 36 so that it assumes angular orientation $\theta_{24}$, for example 40°, as shown in FIG. 15(*c*), thereby increasing the obstruction of the stator passages 80 by the rotor blades 35 and the pressure drop across the pulser 12. Counter rotation of the rotor 36 back to the 0° orientation will result in the completion of the generation of a pressure pulse of increased amplitude $a_2$. Operation is this mode will improved reception of data by the surface pressure sensor 20.

Alternatively, data reception at the surface may be improved by altering the shape of the pressure pulse. For example, suppose that, after a period of time, the pressure pulses of increased amplitude $a_2$ also became difficult to decipher at the surface. According to the invention, the controller 26 could then direct the motor driver 30 to increase the amplitude of the electrical power transmitted to the motor to amplitude $e_2$ while also decreasing the time interval $\Delta t_1''$ during which such power was supplied. The transmission of increased electrical power will increase the speed of rotation of the rotor 36 so that it assumes angular orientation $\theta_2$ sooner and also returns to its initial position sooner, resulting in a pressure pulse that more nearly approximates a square wave. This type of operation is depicted by the dashed lines in FIG. 16.

Alternatively, if it were desired to increase the frequency of the pressure pulses, for example, to avoid confusion with noise existing at a certain frequency, the time intervals $\Delta t_1$ and $\Delta t_2$ during which the rotor is operative and inoperative, respectively, could be shortened or lengthened by the controller 26. Further, in situations in which there were no problems with data reception, the time intervals could be shortened to increase the rate of data transmission, resulting in the transmission of more data over a given timer interval.

Various schemes can be developed for controlling the pressure pulses according to the current invention. For example, the controller 26 could be programmed to automatically increase the pressure pulse amplitude, or automatically make the shape of the pressure pulse more square-like, as the drilling time increased, or as the depth of the bottom hole assembly or its distance from the surface increased. The controller 26 could increase the pulse amplitude as a function of the magnitude of the static pressure of the drilling mud in the vicinity of the pulser 12 as sensed by the static pressure transducer 29—the higher the pressure, the greater the amplitude.

According to a preferred embodiment, proper control is effected by monitoring the pressure pulses generated by the down hole pulser 12 so as to create a feed back loop. This can be done by having the controller 26 make use of the signal from the down hole dynamic pressure sensor 28 and operate the motor so as to satisfy one or more predetermined criteria for the pressure pulse characteristics. For example, the controller 26 could ensure that the pressure pulse amplitude is maintained within a predetermined range or exceeds a predetermined minimum as the drilling progresses and despite changes in drilling mud flow conditions.

As another example, the controller 26 can analyze the characteristics of extraneous pressure pulses in the drilling mud sensed by the pressure sensor 28, for example from the mud pumps, by temporarily ceasing operation of the down hole pulser 12. The controller can then compare the pressure pulses generated by the down hole pulser 12 to those extraneous pressure pulses that were within a predetermined frequency range around that of the frequency of the pressure pulses generated by the pulser. The controller 26 would then increase or decrease the frequency of the pressure pulses generated by the down hole pulser 12 whenever the amplitude of such extraneous pressure pulses exceeded a predetermined absolute or relative amplitude. Alternatively, the shape of the pressure pulses generated by the down hole pulser 12 could be varied to better able the surface detection equipment to distinguish them from extraneous pressure pulses.

In one preferred embodiment of the invention, the down hole dynamic pressure sensor 28 is capable of receiving instructional information from the surface for controlling the pressure pulses. In one version of this embodiment, the information contains direct instructions for setting the timing of the power signals to be supplied by the motor driver 30. For example, the instructions might call for the controller 26 to increase the magnitude of the electrical power supplied to the motor by a specific amount so that the rotor rotated more rapidly thereby altering the shape of the pressure pulses, or increase the duration of each interval during which the motor was energized thereby increasing the duration and amplitude of the pressure pulses, or increase the time interval between each energizing of the motor thereby decreasing the frequency, or data rate.

In another version, instructional information is provided that allows the controller 26 to make the necessary adjustment in motor control based on the sensed characteristics of the pressure pulses generated by the pulser 12. For example, the information transmitted to the pressure sensor 28 could be revised settings for a particular pressure pulse characteristic, such a new range of pressure pulse amplitude within which to operate or a new value for the pressure pulse duration or frequency. Using logic programmed into it, the controller 26 would then adjust the operation of the motor 32 accordingly until the signal from pressure sensor 28 indicated that the new setting for the characteristic had been achieved.

In one version of this embodiment, the instructional information is transmitted to the controller 26 by the surface pulser 22, which generates its own pressure pulses 110 encoded so as to contain the instructional information. The pressure pulses 110 are sensed by the down hole pressure sensor 28 and, using software well know in the art, are decoded by the controller 26. The controller 26 can then effect the proper adjustment and control of the motor operation to ensure that the pressure pulses 112 generated by the down hole pulser 12 have the proper characteristics.

In one version, this is accomplished by having the controller 26 automatically direct the down hole pulser 12 to transmit pressure pulses 112 in a number of predetermined formats, such as a variety of data rates, pulse frequencies or pulse amplitudes, at prescribed intervals. The down hole pulser 12 would then cease operation while the surface detection system analyzed these data, selected the format that afforded optimal data transmission, and, using the surface pulser 22, generated encoded pressure pulses 110 instructing the controller 26 as to the down hole pulser operating mode to be utilized for optimal data transmission.

Alternatively, the controller 26 could be informed that it was about to receive instructions for operating the down hole pulser 12 by sending to the controller the output signal from a conventional flow switch mounted in the bottom hole assembly, such as a mechanical pressure switch that senses the pressure drop in the drilling mud across an orifice, with a low $\Delta P$ indicating the cessation of mud flow and a high $\Delta P$ indicating the resumption of mud flow, or an accelerometer that sensed vibration in the drill string, with the absence of vibration indicating the cessation of mud flow and the presence of vibration indication the resumption of mud flow. The cessation of mud flow, created by shutting down the mud pump, could then be used to signal the controller 26 that, upon resumption of mud flow, it would receive instructions for operating the pulser 12.

According to the invention, the mud pump 16 can be used as the surface pulser 22 by using a very simple encoding scheme that allowed the pressure pulses generated by mud pump operation to contain information for setting a characteristic of the pressure pulses generated by the down hole pulser 12. For example, the speed of the mud pump 16 could be varied so as to vary the frequency of the mud pump pressure pulses that, when sensed by the down hole dynamic pressure sensor 29, signal the controller 26 that a characteristic of the pressure pulses being generated by the down hole pulser 12 should be adjusted in a certain manner.

Although the foregoing aspect of the invention has been discussed by reference to transmitting instructions from the surface down hole to the controller via pressure pulses, other methods of transmitting instructions down hole could also be utilized. For example, the starting and stopping of the mud pump in a prescribed sequence could be used to transmit instructions to the controller 26 by means of a conventional flow switch, such as that discussed above, that sensed the starting and stopping of mud flow. As another example, information can be communicated by modulating the speed of rotation of the drill string in a predetermined pattern so as to transmit encoded data to the controller. In such an communications scheme, triaxial magnetometers and/or accelerometers, such as those conventionally used in positional sensors in bottom hole assemblies, can be used to detect rotation of the drill string. The output signals from these sensors can be transmitted to the controller, which would deciphered encoded instructions from these signals.

Although, according to the current invention, pressure pulses are preferably generated using the oscillating rotary pulser 12 described above, the principle of controlling one or more characteristics of the pressure pulses transmitted to the surface by sensing the generated pressure pulses or by transmitting instructions to the down hole pulser is also applicable to other types of pulsers, including reciprocating valve type pulsers and convention rotary pulsers, provided that, by employing the principals of the current invention, they can be adapted to permit variations in one or more characteristics of the pressure pulses. For example, a special controller, motor driver, variable speed motor and down hole dynamic pressure transducer constructed according to the teachings of the current invention could be incorporated, as required, into a conventional siren type rotary pulser system, discussed above. This would allow the surface detection system to transmit information, by way of pressure pulses generated at the surface as discussed above, to the controller of the down hole pulser instructing it, for example, to increase the rotational speed of the siren because data reception at the surface was being impaired by inference from extraneous pressure pulses at a frequency close to that of the siren frequency. The controller would then instruct the motor driver to increase the electrical power to the motor so as to increase the siren frequency. Alternatively, the controller could instruct the motor so as to adjust the phase shift of the pressure pulses relative to a reference signal that is used to encode the data. As another example, a conventional rotary pulser employing an escapement mechanism actuated by an electrically operated solenoid, such as that discussed above, could be modified with a controller that varied the operation of the solenoid so as to vary the duration or frequency of the pulses, for example, based on a comparison between the sensed duration or frequency of the pressure pulses generated by the down hole pulser or based upon instructions from the surface system deciphered by the down hole dynamic pressure transducer.

Thus, although the current invention has been illustrated by reference to certain specific embodiments, those skilled in the art, armed with the foregoing disclosure, will appreciate that many variations could be employed. For example, although the invention has been discussed with reference to a reversible electric motor, other motors, such as hydraulic motors capable of being quickly energized, could also be utilized.

Therefore, it should be appreciated that the current invention may be embodied in other specific forms without departing from the spirit or essential attributes thereof and, accordingly, reference should be made to the appended claims, rather than to the foregoing specification, as indicating the scope of the invention.

What is claimed:

1. A method for transmitting information from a portion of a drill string operating at a down hole location in a well bore to a location proximate the surface of the earth, a drilling fluid flowing through said drill string through a flow path thereof having a rotor disposed therein, comprising the steps of:

a) generating a sequence of pressure pulses in the drilling fluid at said down hole location that propagate to said surface location, said sequence of pressure pulses generated by operating a drive train that drives said rotor so as to create rotational oscillations in said rotor that alternately block and unblock at least a portion of said drill string flow path by a predetermined amount, said sequence of pressure pulses being encoded with said information to be transmitted, said sequence of pressure pulses having an amplitude defined by the difference between the maximum and minimum values of the pressure of said drilling fluid; and b) controlling said amplitude of said generated encoded sequence of pressure pulses in situ at said down hole location by operating said drive train so as to vary the magnitude of said rotational oscillations of said rotor thereby varying said amount by which said portion of said flow path is alternately blocked and unblocked.

2. A method for transmitting information from a portion of a drill string operating at a down hole location in a well bore to a location proximate the surface of the earth, a drilling fluid flowing through said drill string, comprising the steps of:

a) generating pressure pulses in the drilling fluid at said down hole location that propagate to said surface location, said pressure pulses being encoded with said information to be transmitted;

b) controlling at least one characteristic of said generated pressure pulses in situ at said down hole location; and c) transmitting instructional information from said surface location to said down hole location for controlling said pressure pulse characteristic, and wherein the step of controlling said pressure pulse characteristic comprises controlling said characteristic based upon said transmitted instruction.

3. The method according to claim 2, wherein said at least one pressure pulse characteristic is selected from the group consisting of amplitude, duration, shape, and frequency.

4. The method according to claim 3, wherein said at least one pressure pulse characteristic is amplitude.

5. The method according to claim 2, further comprising the step of sensing said at least one characteristic of said pressure pulses at said down hole location, and wherein the step of controlling said pressure pulse characteristic comprises controlling said pressure characteristic based on said sensing thereof.

6. The method according to claim 2, wherein said pressure pulses generated at said down hole location are first pressure pulses, and wherein the step of transmitting said instructional information to said down hole location comprises (i) generating second pressure pulses proximate said surface location that propagate to said down hole location, said second pressure pulses encoded with said instructional information, and (ii) sensing said second pressure pules at said down hole location.

7. A method for transmitting information from a portion of a drill string operating at a down hole location in a well bore to a location proximate the surface of the earth, a drilling fluid flowing through said drill string, comprising the steps of:

a) directing said drilling fluid along a flow path extending through said down hole portion of said drill string;

b) directing said drilling fluid over a rotor disposed in said down hole portion of said drill string, said rotor capable of at least partially obstructing the flow of fluid through said flow path by rotating in a first direction and of thereafter reducing said obstruction of said flow path by rotating in an opposite direction, said rotation of said rotor driven by a drive train, said rotor drive train comprising a motor;

c) creating a sequence of pressure pulses in said drilling fluid that propagate toward said surface location, said sequence of pressure pulses encoded to contain said information to be transmitted, said sequence of pressure pulses created by oscillating the rotation of said rotor, said rotor oscillated by operating said rotor drive train so as to rotate said rotor in said first direction through an angle of rotation thereby at least partially obstructing said flow path and then operating said rotor drive train so as to reverse said direction of rotation of said rotor so that said rotor rotates in said opposite direction thereby reducing said obstruction of said flow path; and d) making an adjustment to at least one characteristic of said sequence of pressure pulses by adjusting said operation of said rotor drive train so as to alter said oscillation of said rotor, said at least one pressure pulse characteristic selected from the group consisting of amplitude, duration, shape, and frequency, said adjustment of said oscillation of said rotor performed in situ at said down hole location.

8. The method according to claim 7, wherein said pressure pulse characteristic adjusted in step (d) comprises said amplitude of said pressure pulses.

9. The method according to claim 7, wherein said pressure pulse characteristic adjusted in step (d) comprises said shape of said pressure pulses.

10. The method according to claim 9, wherein the step of adjusting said shape of said pressure pulses comprises changing the speed at which said rotor rotates in at least one of said first and second directions.

11. The method according to claim 7, wherein said pressure pulse characteristic adjusted in step (d) comprises said duration of each of said pressure pulses.

12. A method for transmitting information from a portion of a drill string operating at a down hole location in a well bore to a location proximate the surface of the earth, a drilling fluid flowing through said drill string, comprising the steps of:

a) directing said drilling fluid along a flow path extending through said down hole portion of said drill string;

b) directing said drilling fluid over a rotor disposed in said down hole portion of said drill string, said rotor capable of at least partially obstructing the flow of fluid through said flow path by rotating in a first direction and of thereafter reducing said obstruction of said flow path by rotating in an opposite direction, said rotation of said rotor driven by a drive train, said rotor drive train comprising a motor;

c) creating a sequence of pressure pulses in said drilling fluid that propagate toward said surface location, said sequence of pressure pulses encoded to contain said information to be transmitted, said sequence of pressure pulses created by oscillating the rotation of said rotor, said rotor oscillated by operating said rotor drive train so as to rotate said rotor in said first direction through an angle of rotation thereby at least partially obstructing said flow path and then operating said rotor drive train so as to reverse said direction of rotation of said rotor so that said rotor rotates in said opposite direction thereby reducing said obstruction of said flow path;

d) sensing the pressure of said drilling fluid at a location proximate said down hole portion of said drill string; and e) making an adjustment to at least the amplitude of said sequence of pressure pulses by adjusting said operation of said rotor drive train so as to alter said oscillation of said rotor, said adjustment of said oscillation of said rotor performed in situ at said down hole location by varying said angle of rotation of said rotor based on said sensed pressure of said drilling fluid.

13. A method for transmitting information from a portion of a drill string operating at a down hole location in a well bore to a location proximate the surface of the earth, a drilling fluid flowing through said drill string, comprising the steps of:

a) progressively drilling said well bore further into the earth, thereby further displacing said portion of said drill string from said surface location;

b) directing said drilling fluid along a flow path extending through said down hole portion of said drill string;

c) directing said drilling fluid over a rotor disposed in said down hole portion of said drill string, said rotor capable of at least partially obstructing the flow of fluid through said flow path by rotating in a first direction and of thereafter reducing said obstruction of said flow path by rotating in an opposite direction, said rotation of said rotor driven by a drive train, said rotor drive train comprising a motor;

d) creating a sequence of pressure pulses in said drilling fluid that propagate toward said surface location, said sequence of pressure pulses encoded to contain said information to be transmitted, said sequence of pressure pulses created by oscillating the rotation of said rotor, said rotor oscillated by operating said rotor drive train so as to rotate said rotor in said first direction through an angle of rotation thereby at least partially obstructing said flow path and then operating said rotor drive train so as to reverse said direction of rotation of said rotor so that said rotor rotates in said opposite direction thereby reducing said obstruction of said flow path; and e) making an adjustment to at least the amplitude of said sequence of pressure pulses by adjusting said operation of said rotor drive train so as to alter said oscillation of said rotor, said adjustment of said oscillation of said rotor performed in situ at said down hole location by increasing said angle of rotation of said rotor so as to increase said amplitude of said pressure pulses as said drilling progresses.

14. A method for transmitting information from a portion of a drill string operating at a down hole location in a well bore to a location proximate the surface of the earth, a drilling fluid flowing through said drill string, comprising the steps of:

a) directing said drilling fluid along a flow path extending through said down hole portion of said drill string;

b) directing said drilling fluid over a rotor disposed in said down hole portion of said drill string, said rotor capable of at least partially obstructing the flow of fluid through said flow path by rotating in a first direction and of thereafter reducing said obstruction of said flow path by rotating in an opposite direction;

c) creating pressure pulses in said drilling fluid that propagate toward said surface location, said pressure pulses encoded to contain said information to be transmitted, each of said pressure pulses created by oscillating said rotor by rotating said rotor in said first direction through an angle of rotation so as to obstruct said flow path and then reversing said direction of rotation and rotating said rotor in said opposite direction so as to reduce said obstruction of said flow path, wherein a motor drives said rotation of said rotor, and wherein said rotor is oscillated by operating said motor over discrete time intervals; and d) making an adjustment to at least one characteristic of said pressure pulses by adjusting said oscillation of said rotor by translating said information to be transmitted into a series of said discrete motor operating time intervals, said at least one pressure pulse characteristic selected from the group consisting of amplitude, duration, shape, and frequency, said adjustment of said oscillation of said rotor performed in situ at said down hole location.

15. A method for transmitting information from a portion of a drill string operating at a down hole location in a well bore to a location proximate the surface of the earth, a drilling fluid flowing through said drill string, comprising the steps of:

a) directing said drilling fluid along a flow path extending through said down hole portion of said drill string;

b) directing said drilling fluid over a rotor disposed in said down hole portion of said drill string, said rotor capable of at least partially obstructing said flow path by rotating in a first direction and of thereafter reducing said obstruction of said flow path by rotating in an opposite direction;

c) oscillating rotation of said rotor by repeatedly rotating said rotor in said first direction through an angle of oscillation so as to at least partially obstruct said flow path and then rotating said rotor in said opposite direction so as to reduce said obstruction, thereby creating in said drilling fluid pressure pulses that are encoded to contain said information to be transmitted from said down hole location and that propagate toward said surface location;

d) transmitting instructional information from said surface location to said down hole portion of said drill string for controlling at least one characteristic of said pressure pulses, said at least one pressure pulse characteristic selected from the group consisting of amplitude, duration, shape, frequency, and phase;

e) receiving and deciphering said instructional information at said down hole portion of said drill string so as to determine said instruction for controlling said at least one characteristic of said pressure pulses; and f) controlling said at least one characteristic of said pressure pulses based upon said deciphered instruction,

16. The method according to claim 15, wherein said pressure pulse characteristic controlled in step (f) comprises said amplitude of said pressure pulses.

17. The method according to claim 16, wherein the step of controlling said amplitude of said pressure pulses comprises adjusting said angle through which said rotor oscillates.

18. The method according to claim 16, further comprising the step of sensing said amplitude of said pressure pulses proximate said down hole location, wherein said instruction for controlling said amplitude of said pressure pulses comprises a criteria for said sensed amplitude of said pressure pulses, and wherein said angle of oscillation of said rotor is adjusted so as to satisfy said criteria.

19. The method according to claim 16, wherein said pressure pulses propagating toward said surface location are first pressure pulses in said drilling fluid, and wherein the step of transmitting instructional information from said surface location to said down hole portion of said drill string comprises creating second pressure pulses in said drilling fluid, said second pressure pulses created at said surface location and propagating through said drilling fluid to said down hole portion of said drill string.

20. A method for transmitting information from a portion of a drill string operating at a down hole location in a well bore to a location proximate the surface of the earth, a drilling fluid flowing through said drill string, comprising the steps of:

a) directing said drilling fluid along a flow path extending through said down hole portion of said drill string;

b) creating first pressure pulses in said drilling fluid by operating a first pulser disposed at said down hole location, said first pressure pulses propagating to said surface location, said first pressure pulses encoded to contain said information to be transmitted to said surface location;

d) creating second pressure pulses in said drilling fluid by operating a second pulser disposed proximate said surface location, said second pressure pulses propagating to said down hole location, said second pressure pulses encoded to contain an instruction for setting at least one characteristic of said first pressure pulses, said at least one characteristic of said first pressure pulses selected from the group consisting of amplitude, duration, shape, frequency, and phase; and e) sensing said second pressure pulses at said down hole location and deciphering said instruction encoded therein; and f) setting said at least one characteristic of said first pressure pulses based upon said deciphered instruction, said setting of said characteristic performed by adjusting said operation of said first pulser in situ at said down hole location.

21. The method according to claim 20, wherein said pressure pulse characteristic set in step (f) comprises said amplitude of said first pressure pulses.

22. The method according to claim 20, wherein said pressure pulse characteristic set in step (f) comprises said duration of each of said first pressure pulses.

23. The method according to claim 20, wherein said pressure pulse characteristic set in step (f) comprises said shape of said first pressure pulses.

24. The method according to claim 20, wherein said pressure pulse characteristic set in step (f) comprises said frequency of said first pressure pulses.

25. The method according to claim 20, wherein said pressure pulse characteristic set in step (f) comprises said phase of said first pressure pulses relative to a reference signal.

26. The method according to claim 20, wherein second pulser is a pump for pumping said drilling fluid through said drill string.

27. A method for transmitting information from a portion of a drill string operating at a down hole location in a well bore to a location proximate the surface of the earth, a drilling fluid flowing through said drill string, comprising the steps of:

a) directing said drilling fluid to flow along a flow path extending through said down hole portion of said drill string;

b) directing said drilling fluid over a rotor driven by a motor, said rotor capable of obstructing said flow path when rotated by said motor into a first angular orientation and of reducing said obstruction of said flow path when rotated by said motor into a second angular orientation;

c) creating a series of pressure pulses in said drilling fluid that are encoded to contain said information to be transmitted and that propagate toward said surface location, each of said pressure pulses created by:

(i) rotating said rotor in a first direction from said second angular orientation toward said first angular orientation by energizing said motor for a first period of time, (ii) stopping rotation of said rotor in said first direction by de-energizing said motor at the end of said first period of time, whereby said rotor stops at said first angular orientation without resort to mechanical stops, (iii) after a second period of time, rotating said rotor in an opposite direction toward said second angular orientation by energizing said motor for a third period of time, and (iv) stopping rotation of said rotor in said opposite direction by de-energizing said motor at the end of said third period of time.

28. The method according to claim 27, wherein each of said pressure pulses has an amplitude, and further comprising the step of controlling the amplitude of said pressure pulses by varying said first period of time.

29. The method according to claim 27, wherein said series of pressure pulses are created at a frequency, and further comprising the step of controlling said frequency by varying said second period of time.

30. The method according to claim 27, further comprising the step of sensing the angular orientation of said rotor, and wherein the end of said first period of time is based upon said sensed angular orientation of said rotor.

31. The method according to claim 27, wherein said first and third periods of time are equal.

32. The method according to claim 27, wherein said second period of time is essentially zero.

33. The method according to claim 27, wherein rotation of said rotor is stopped at said second angular orientation without resort to mechanical stops.

34. The method according to claim 27, wherein said motor is energized for said first period of time by energizing said motor over a series of discrete time increments spanning said period of time.

35. An apparatus for transmitting information from a portion of a drill string operating at a down hole location in a well bore to a location proximate the surface of the earth, said drill string having a passage through which a drilling fluid flows, comprising:

a) a housing for mounting in said drill string passage, first and second chambers formed in said housing, said first and second chambers being separated from each other, said first chamber filled with a gas, said second chamber filled with a liquid;

b) a rotor capable of at least partially obstructing the flow of said drilling fluid through said passage when rotated into a first angular orientation and of reducing said obstruction when rotated into a second angular orientation, whereby rotation of said rotor creates pressure pulses in said drilling fluid;

c) a drive train for rotating said rotor, at least a first portion of said drive train located in said liquid filled second chamber;

d) an electric motor for driving rotation of said drive train, said electric motor located in said gas-filled first chamber.

36. The apparatus according to claim 35, wherein said first portion of said drive train comprises a reduction gear.

37. The apparatus according to claim 35, further comprising a piston driven by said drilling fluid for pressurizing said liquid-filled second chamber.

38. The apparatus according to claim 35, wherein said drive train comprises a magnetic coupling.

39. The apparatus according to claim 36, wherein said magnetic coupling comprises first and second magnets, said first magnet disposed in said gas-filled first chamber and said second magnet disposed in said liquid-filled second chamber.

40. The apparatus according to claim 35, further comprising means for adjusting at least one characteristic of said pressure pulses.

41. The apparatus according to claim 40, wherein said at least one pressure characteristic is the amplitude of said pressure pulses, and wherein said means for adjusting said amplitude of said pressure pulses comprises a transducer for sensing the amplitude of said pressure pulses proximate said housing.

42. An apparatus for transmitting information from a portion of a drill string operating at a down hole location in a well bore to a location proximate the surface of the earth, said drill string having a passage through which a drilling fluid flows, comprising:

a) a pulser disposed at said down hole location for creating a sequence of pressure pulses in said drilling fluid that propagate toward said surface location, said pulser having oscillating means for alternately blocking and unblocking at least a portion of said passage so as to create a sequence of pressure pulses that are encoded to contain said information to be transmitted, said sequence of pressure pulses having an amplitude defined by the difference between the maximum and minimum values of the pressure of said drilling fluid; and b) means for adjusting said amplitude of said sequence of pressure pulses by adjusting operation of said pulser oscillating means in situ at said down hole location so as to vary the amount by which said portion of said passage is alternately blocked and unblocked.

43. The apparatus according to claim 42, wherein said means for adjusting said amplitude of said pressure pulse comprises a transducer for sensing pressure pulses in said drilling fluid proximate said down hole location.

44. An apparatus for transmitting information from a portion of a drill string operating at a down hole location in a well bore to a location proximate the surface of the earth, said drill string having a passage through which a drilling fluid flows, comprising:

a) a pulser disposed at said down hole location for creating pressure pulses in said drilling fluid that propagate toward said surface location and that are encoded to contain said information to be transmitted, said pulser comprising a rotor capable of at least partially obstructing the flow of fluid through said passage by rotating in a first direction through an angle of rotation and of thereafter reducing said obstruction of said passage by rotating in an opposite direction; and b) means for adjusting at least one characteristic of said pressure pulses by adjusting operation of said pulser in situ at said down hole location, said means for adjusting operation of said pulser comprising means for adjusting said rotation of said rotor.

45. The apparatus according to claim 44, wherein said at least one characteristic of said pressure pulses is the amplitude of said pressure pulses, and wherein said means for means for adjusting said amplitude of said pressure pulses comprises means for varying said angle of rotation of said rotor.

46. The apparatus according to claim 44, wherein said pulser further comprises a motor for rotating said rotor in said first and opposition directions, and wherein said means for adjusting said pressure pulse characteristic comprises means for translating said information to be transmitted into a series of time intervals during which said motor is operated in said first and opposite directions.

47. The apparatus according to claim 44, wherein said means for adjusting said pressure pulse characteristic comprises means for translating said information into a series of angular rotations of said rotor.

48. An apparatus for transmitting information from a portion of a drill string operating at a down hole location in a well bore to a location proximate the surface of the earth, said drill string having a passage through which a drilling fluid flows, comprising:

a) a pulser disposed at said down hole location for creating pressure pulses in said drilling fluid that propagate toward said surface location and that are encoded to contain said information to be transmitted;

b) means for adjusting at least one characteristic of said pressure pulses by adjusting operation of said pulser in situ at said down hole location; and c) means for receiving information transmitted from said surface location to said down hole location encoded to contain an instruction for adjusting said characteristic of said pressure pulses.

49. The apparatus according to claim 48, wherein said information receiving means comprises means for sensing pressure pulsations in said drilling fluid.

50. An apparatus for transmitting information from a portion of a drill string operating at a down hole location in a well bore to a location proximate the surface of the earth, a drilling fluid flowing through said drill string, comprising:

a) a first pulser for creating first pressure pulses in said drilling fluid that propagate to said surface location, said first pulser disposed at said down hole location, said first pressure pulses encoded to contain said information to be transmitted to said surface location;

b) a second pulser for creating second pressure pulses in said drilling fluid that propagate to said down hole location, said second pulser disposed proximate said surface location, said second pressure pulses encoded to contain an instruction for setting at least one characteristic of said first pressure pulses; and c) means for setting, in situ at said down hole location, said at least one characteristic of said first pressure pulses based upon said instruction encoded in said second pressure pulses.

51. An apparatus for transmitting information from a portion of a drill string operating at a down hole location in a well bore to a location proximate the surface of the earth, said drill string through which a drilling fluid flows, comprising:

a) a stationary assembly for mounting in said drill string and having at least one passage through which said drilling fluid flows;

b) a rotor mounted in said drill string proximate said stationary member and capable of at least partially obstructing the flow of said drilling fluid through said passage when rotated into a first angular orientation and of reducing said obstruction when rotated into a second angular orientation, whereby oscillation of said rotor between said first and second angular orientations creates pressure pulses in said drilling fluid encoded to contain said information; and c) a flexible seal spanning from said rotor to said stationary assembly, said seal having a first end fixedly attached to said rotor and a second end fixedly attached to said stationary assembly, whereby oscillation of said rotor causes said seal to undergo torsional deflection.

52. An apparatus for transmitting information from a portion of a drill string operating at a down hole location in a well bore to a location proximate the surface of the earth, said drill string through which a drilling fluid flows, comprising:

a) a stationary assembly for mounting in said drill string and having at least one passage through which said drilling fluid flows;

b) a rotor mounted in said drill string proximate said stationary member and capable of at least partially obstructing the flow of said drilling fluid through said passage when rotated into a first angular orientation and of reducing said obstruction when rotated into a second angular orientation, whereby oscillation of said rotor between said first and second angular orientations creates pressure pulses in said drilling fluid encoded to contain said information;

c) means for preventing debris in said drilling fluid from jamming rotation of said rotor.

53. The apparatus according to claim 52, wherein said rotor has a plurality of blades extending radially outward therefrom, each of said blades having a first radially extending edge having a length $l_1$ and a second radially extending edge opposite said first edge, said second edge having a length $l_2$, and wherein said means for preventing jamming comprises $l_2$ being longer than $l_1$.

54. The apparatus according to claim 52, wherein said rotor has a plurality of blades extending radially outward therefrom, each of said blades having a first radially extending edge and a second radially extending edge circumferentially displaced from said first edge, each of said blades being axially displaced from said stationary assembly by a circumferentially extending gap, and wherein said means for preventing jamming comprises said gap varying as it extends circumferentially from said first edge to said second edge.

* * * * *

UNITED STATES PATENT AND TRADEMARK OFFICE

CERTIFICATE OF CORRECTION

PATENT NO. : 6,714,138 B1 
DATED : March 30, 2004
INVENTOR(S) : William Evans Turner and Denis P. Biglin, Jr.

It is certified that error appears in the above-identified patent and that said Letters Patent is hereby corrected as shown below:

Title page,
Item [73], Assignee, please delete "TN" and insert -- CT -- therefor.

Column 6,
Line 2, please delete "sting" and insert -- string -- therefor.

Column 8,
Line 35, please delete "cental" and insert -- central -- therefor.
Line 66, please delete "air-filed" and insert -- air-filled -- therefor.
Line 67, please delete "oil-filed" and insert -- oil-filled -- therefor.

Column 10,
Line 22, please delete "come" and insert -- some -- therefor.

Column 13,
Line 25, after "pulser 12.", there should not be a new paragraph. Please continue on with next sentence "Therefore, as used herein,…" therefor.

Column 14,
Line 34, please delete "be" (first occurrence).

Column 15,
Line 28, please delete "angle θ1," and insert -- angle $\theta_1$, -- therefor.
Line 52, please delete "orientation $\theta_{24}$," and insert -- orientation $\theta_2$, -- therefor.
Line 58, please delete "improved" and insert -- improve -- therefor.

Column 18,
Line 11, please delete "an" and insert -- a -- therefor.
Line 16, please delete "deciphered" and insert -- decipher -- therefor.

Column 19,
Line 61, please delete "pules" and insert -- pulses -- therefor.

Column 22,
Line 58, please delete "instruction," and insert -- instruction. -- therefor.

UNITED STATES PATENT AND TRADEMARK OFFICE

CERTIFICATE OF CORRECTION

PATENT NO. : 6,714,138 B1 
DATED : March 30, 2004
INVENTOR(S) : William Evans Turner and Denis P. Biglin, Jr.

It is certified that error appears in the above-identified patent and that said Letters Patent is hereby corrected as shown below:

Column 27,
Lines 25-26, after "obstructing the flow of said", there should not be a new paragraph. Please continue on with "drilling fluid through said passage…" therefor.

Signed and Sealed this

Second Day of August, 2005

JON W. DUDAS
*Director of the United States Patent and Trademark Office*